US005576129A

United States Patent [19]

Zwartz et al.

[11] Patent Number: 5,576,129

[45] Date of Patent: Nov. 19, 1996

[54] MIGRATION IMAGING MEMBERS

[75] Inventors: Edward G. Zwartz; Carol A. Jennings; Man C. Tam, all of Mississauga; Philip H. Soden, Oakville; Arthur Y. Jones, Mississauga; Arnold L. Pundsack, Georgetown, all of Canada; Enrique Levy, Englewood, N.J.; Ah-Mee Hor, Mississauga, Canada; William W. Limburg, Penfield, N.Y.; John F. Yanus, Webster, N.Y.; Damodar M. Pai, Fairport, N.Y.; Dale S. Renfer, Webster, N.Y.

[73] Assignee: Xerox Corporation, Stamford, Conn.

[21] Appl. No.: 353,461

[22] Filed: Dec. 9, 1994

[51] Int. Cl.[6] ..... G03G 13/26

[52] U.S. Cl. ..... 430/41

[58] Field of Search ..... 430/41

[56] References Cited

U.S. PATENT DOCUMENTS

| | | | |
|---|---|---|---|
| 3,598,644 | 8/1971 | Gaffe | 117/201 |
| 3,741,758 | 6/1973 | Chrzanowski | 96/1 R |
| 3,840,397 | 10/1974 | Amidon et al. | 117/201 |
| 3,909,262 | 9/1975 | Goffe et al. | 96/1.5 |
| 3,923,504 | 12/1975 | Bean | 430/41 |
| 3,982,939 | 9/1976 | Bean | 96/1.5 |
| 4,482,622 | 11/1984 | Soden et al. | 430/135 |
| 4,536,457 | 8/1985 | Tam | 430/41 |
| 4,536,458 | 8/1985 | Ng | 430/41 |
| 4,970,130 | 11/1990 | Tam et al. | 430/41 |
| 5,102,756 | 4/1992 | Vincett et al. | 430/41 |
| 5,215,838 | 4/1993 | Tam et al. | 430/41 |
| 5,260,095 | 11/1993 | Affinito | 427/124 |

*Primary Examiner*—Mark Chapman
*Attorney, Agent, or Firm*—Judith L. Byorick

[57] ABSTRACT

Disclosed is a migration imaging member comprising a substrate, a first softenable layer comprising a first softenable material and a first migration marking material contained at or near the surface of the first softenable layer spaced from the substrate, and a second softenable layer comprising a second softenable material and a second migration marking material. Also disclosed is a migration imaging process employing the aforesaid imaging member.

41 Claims, 14 Drawing Sheets

MIGRATION IMAGING MEMBERS

BACKGROUND OF THE INVENTION

The present invention is directed to migration imaging members. More specifically, the present invention is directed to migration imaging members having improved optical contrast. One embodiment of the present invention is directed to a migration imaging member comprising a substrate, a first softenable layer comprising a first softenable material and a first migration marking material contained at least at or near the surface of the first softenable layer spaced from the substrate, and a second softenable layer comprising a second softenable material and a second migration marking material. Another embodiment of the present invention is directed to a migration imaging process which comprises (1) providing a migration imaging member comprising a substrate, a first softenable layer comprising a first softenable material and a first migration marking material contained at least at or near the surface of the first softenable layer spaced from the substrate, and a second softenable layer comprising a second softenable material and a second migration marking material; (2) uniformly charging the imaging member; (3) subsequent to step (2), exposing the charged imaging member to activating radiation at a wavelength to which the migration marking materials are sensitive in an imagewise pattern, thereby forming an electrostatic latent image on the imaging member; and (4) subsequent to step (3), causing the softenable materials to soften, thereby enabling the migration marking materials to migrate through the softenable materials toward the substrate in an imagewise pattern. Yet another embodiment of the present invention is directed to a process for preparing a migration imaging member which comprises (1) applying to an imaging member substrate a first softenable layer comprising a first softenable material and a first migration marking material contained at least at or near the surface of the first softenable layer spaced from the substrate, wherein additional layers are optionally situated between the substrate and the first softenable layer; (2) applying to a support a second softenable layer comprising a second softenable material and a second migration marking material, wherein additional layers are optionally situated between the support and the second softenable layer; (3) subsequent to steps (1) and (2), placing the first softenable layer in contact with the second softenable layer and causing the first softenable layer to adhere to the second softenable layer; and (4) subsequent to step (3), removing the support from the second softenable layer. Still another embodiment of the present invention is directed to a process for preparing a migration imaging member which comprises (1) applying to a first support a first softenable layer comprising a first softenable material and a first migration marking material contained at least at or near the surface of the first softenable layer spaced from the first support, wherein additional layers are optionally situated between the first support and the first softenable layer; (2) applying to a second support a second softenable layer comprising a second softenable material and a second migration marking material, wherein additional layers are optionally situated between the second support and the second softenable layer; (3) subsequent to steps (1) and (2), placing the first softenable layer in contact with the second softenable layer and causing the first softenable layer to adhere to the second softenable layer; (4) subsequent to step (3), removing the support from the first softenable layer; (5) subsequent to step (4), placing the first softenable layer in contact with a substrate and causing the first softenable layer to adhere to the substrate, wherein additional layers are optionally situated between the substrate and the first softenable layer; and (6) subsequent to step (5), removing the support from the second softenable layer.

Migration imaging systems capable of producing high quality images of high optical contrast density and high resolution have been developed. Such migration imaging systems are disclosed in, for example, U.S. Pat. No. 3,975,195 (Goffe), U.S. Pat. No. 3,909,262 (Goffe et al.), U.S. Pat. No. 4,536,457 (Tam), U.S. Pat. No. 4,536,458 (Ng), U.S. Pat. No. 4,013,462 (Goffe et al.), and "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosures of each of which are totally incorporated herein by reference. Migration imaging members containing charge transport materials in the softenable layer are also known, and are disclosed, for example, in U.S. Pat. Nos. 4,536,457 (Tam) and 4,536,458 (Ng). In a typical embodiment of these migration imaging systems, a migration imaging member comprising a substrate, a layer of softenable material, and photosensitive marking material is imaged by first forming a latent image by electrically charging the member and exposing the charged member to a pattern of activating electromagnetic radiation such as light. Where the photosensitive marking material is originally in the form of a fracturable layer contiguous with the upper surface of the softenable layer, the marking particles in the exposed area of the member migrate in depth toward the substrate when the member is developed by softening the softenable layer.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In known migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded.

U.S. Pat. No. 4,536,458 (Ng), the disclosure of which is totally incorporated herein by reference, discloses a migration imaging member comprising a substrate and an electrically insulating softenable layer on the substrate, the softenable layer comprising migration marking material located at least at or near the surface of the softenable layer spaced from the substrate, and a charge transport molecule. The migration imaging member is electrostatically charged, exposed to activating radiation in an imagewise pattern, and developed by decreasing the resistance to migration, by exposure either to solvent vapor or heat, of marking material in depth in the softenable layer at least sufficient to allow migration of marking material whereby marking material migrates toward the substrate in image configuration. The preferred thickness of the softenable layer is about 0.7 to 2.5 microns, although thinner and thicker layers can also be utilized.

U.S. Pat. No. 4,536,457 (Tam), the disclosure of which is totally incorporated herein by reference, discloses a process in which a migration imaging member comprising a substrate and an electrically insulating softenable layer on the substrate, the softenable layer comprising migration marking material located at least at or near the surface of the softenable layer spaced from the substrate, and a charge transport molecule (e.g. the imaging member described in U.S. Pat. No. 4,536,458) is uniformly charged and exposed to activating radiation in an imagewise pattern. The resistance to migration of marking material in the softenable layer is thereafter decreased sufficiently by the application of solvent vapor to allow the light exposed particles to retain a slight net charge to prevent agglomeration and coalescence and to allow slight migration in depth of marking material towards the substrate in image configuration, and the resistance to migration of marking material in the softenable layer is further decreased sufficiently by heating to allow non-exposed marking material to agglomerate and coalesce. The preferred thickness is about 0.5 to 2.5 microns, although thinner and thicker layers can be utilized.

U.S. Pat. No. 4,970,130 (Tam et al.), the disclosure of which is totally incorporated herein by reference, discloses a xeroprinting process which comprises (1) providing a xeroprinting master comprising (a) a substrate and (b) a softenable layer comprising a softenable material, a charge transport material capable of transporting charges of one polarity and migration marking material situated contiguous to the surface of the softenable layer spaced from the substrate, wherein a portion of the migration marking material has migrated through the softenable layer toward the substrate in imagewise fashion; (2) uniformly charging the xeroprinting master to a polarity opposite to the polarity of the charges that the charge transport material in the softenable layer is capable of transporting; (3) uniformly exposing the charged master to activating radiation, thereby discharging those areas of the master wherein the migration marking material has migrated toward the substrate and forming an electrostatic latent image; (4) developing the electrostatic latent image; and (5) transferring the developed image to a receiver sheet. The process results in greatly enhanced contrast potentials or contrast voltages between the charged and uncharged areas of the master subsequent to exposure to activating radiation, and the charged master can be developed with either liquid developers or dry developers. The contrast voltage of the electrostatic latent image obtainable from this process generally initially increases with increasing flood exposure light intensity, typically reaches a plateau value of about 90 percent of the initially applied voltage even with further increase in flood exposure light intensity.

U.S. Pat. No. 5,215,838 (Tam et al.), the disclosure of which is totally incorporated herein by reference, discloses a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light radiation sensitive pigment is sensitive contained at or near the surface of the softenable layer. When the migration imaging member is imaged and developed, it is particularly suitable for use as a xeroprinting master and can also be used for viewing or for storing data.

Migration imaging members are also suitable for other purposes, such as use as masks for exposing the photosensitive material in a printing plate for processes such as lithographic printing, and the like.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

While known imaging members and imaging processes are suitable for their intended purposes, a need remains for improved migration imaging members. In addition, a need remains for migration imaging members with improved optical contrast density. Further, there is a need for migration imaging members wherein the optical density of the $D_{max}$ areas of the imaged member is increased without a corresponding increase in the optical density of the $D_{min}$ areas of the imaged member. Additionally, there is a need for migration imaging members wherein the optical density of the $D_{max}$ areas of the imaged member with respect to ultraviolet light passing through the imaging member is increased without a corresponding increase in the optical density of the $D_{min}$ areas of the imaged member with respect to ultraviolet light passing through the imaging member.

SUMMARY OF THE INVENTION

It is an object of the present invention to provide migration imaging members with the above noted advantages.

It is another object of the present invention to provide improved migration imaging members.

It is yet another object of the present invention to provide migration imaging members with improved optical contrast density.

It is still another object of the present invention to provide migration imaging members wherein the optical density of the $D_{max}$ areas of the imaged member is increased without a corresponding increase in the optical density of the $D_{min}$ areas of the imaged member.

Another object of the present invention is to provide migration imaging members wherein the optical density of the $D_{max}$ areas of the imaged member with respect to ultraviolet light passing through the imaging member is increased without a corresponding increase in the optical density of the $D_{min}$ areas of the imaged member with respect to ultraviolet light passing through the imaging member.

These and other objects of the present invention (or specific embodiments thereof) can be achieved by providing a migration imaging member comprising a substrate, a first softenable layer comprising a first softenable material and a first migration marking material contained at least at or near the surface of the first softenable layer spaced from the substrate, and a second softenable layer comprising a second softenable material and a second migration marking material. Another embodiment of the present invention is directed to a migration imaging process which comprises (1) providing a migration imaging member comprising a substrate, a first softenable layer comprising a first softenable material and a first migration marking material contained at least at or near the surface of the first softenable layer spaced from the substrate, and a second softenable layer comprising a second softenable material and a second migration marking material; (2) uniformly charging the imaging member; (3) subsequent to step (2), exposing the charged imaging member to activating radiation at a wavelength to which the migration marking materials are sensitive in an imagewise pattern, thereby forming an electrostatic latent image on the imaging member; and (4) subsequent to step (3), causing the softenable materials to soften, thereby enabling the migration marking materials to migrate through the softenable materials toward the substrate in an imagewise pattern. Yet another embodiment of the present invention is directed to a process for preparing a migration imaging member which comprises (1) applying to an imaging member substrate a first softenable layer comprising a first softenable material and a first migration marking material contained at least at or near the surface of the first softenable layer spaced from the substrate, wherein additional layers are optionally situated between the substrate and the first softenable layer; (2) applying to a support a second softenable layer comprising a second softenable material and a second migration marking material, wherein additional layers are optionally situated between the support and the second softenable layer; (3) subsequent to steps (1) and (2), placing the first softenable layer in contact with the second softenable layer and causing the first softenable layer to adhere to the second softenable layer; and (4) subsequent to step (3), removing the support from the second softenable layer. Still another embodiment of the present invention is directed to a process for preparing a migration imaging member which comprises (1) applying to a first support a first softenable layer comprising a first softenable material and a first migration marking material contained at least at or near the surface of the first softenable layer spaced from the first support, wherein additional layers are optionally situated between the first support and the first softenable layer; (2) applying to a second support a second softenable layer comprising a second softenable material and a second migration marking material, wherein additional layers are optionally situated between the second support and the second softenable layer; (3) subsequent to steps (1) and (2), placing the first softenable layer in contact with the second softenable layer and causing the first softenable layer to adhere to the second softenable layer; (4) subsequent to step (3), removing the support from the first softenable layer; (5) subsequent to step (4), placing the first softenable layer in contact with a substrate and causing the first softenable layer to adhere to the substrate, wherein additional layers are optionally situated between the substrate and the first softenable layer; and (6) subsequent to step (5), removing the support from the second softenable layer.

DETAILED DESCRIPTION OF THE INVENTION

Figure 1:
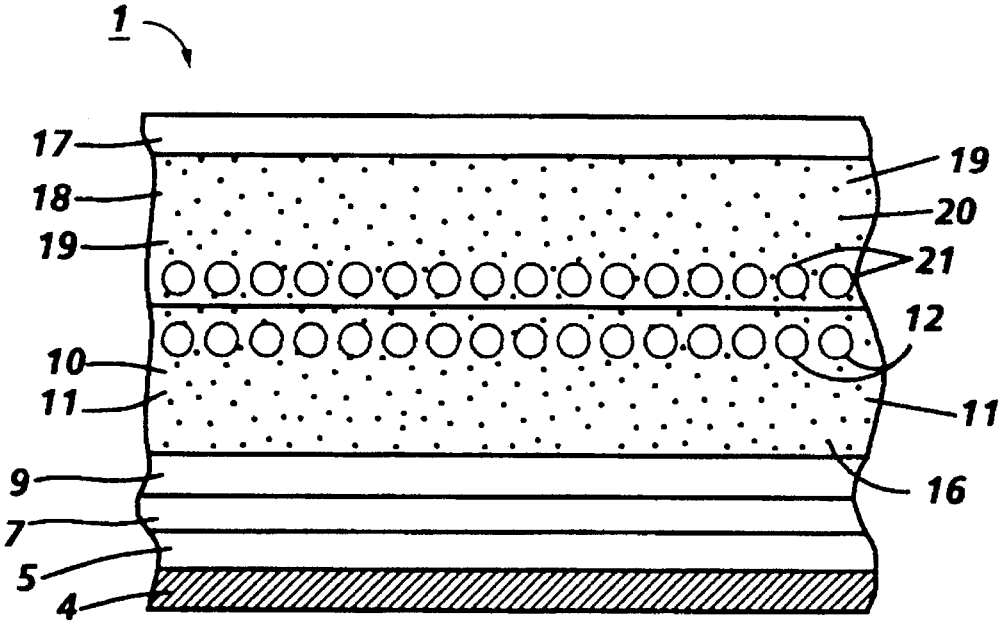
FIGS. 1, 2, and 3 illustrate schematically migration imaging members of the present invention.
Figure 2:
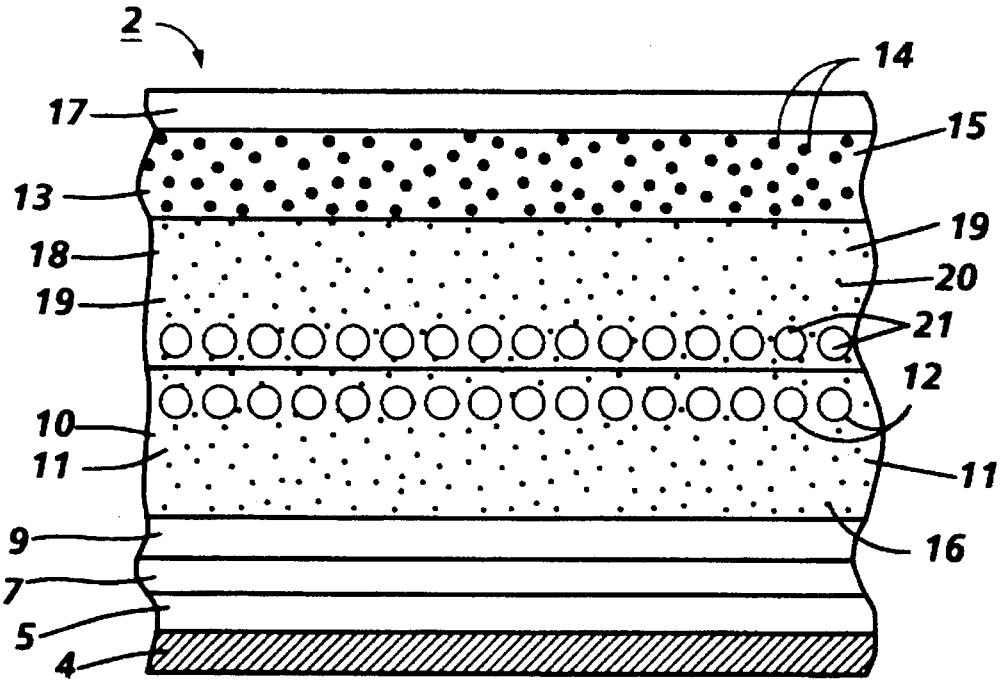
Figure 3:
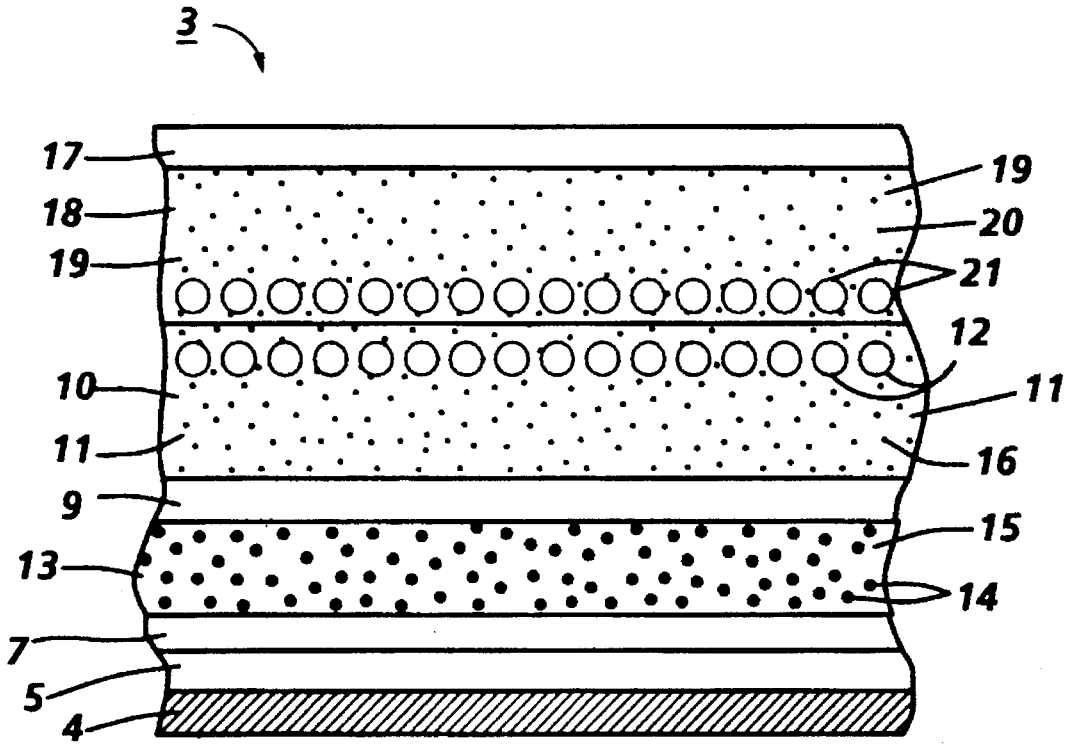

The migration imaging member of the present invention comprises a substrate, a first softenable layer comprising a first softenable material and a first migration marking material contained at or near the surface of the first softenable layer spaced from the substrate, and a second softenable layer comprising a second softenable material and a second migration marking material. The migration marking material in the second softenable layer can be situated at any location within the layer. For example, as shown in FIGS. 1, 2, and 3, the second migration marking material can be situated at or near the surface of the second softenable layer in contact with the first softenable layer. Alternatively, the second migration marking material can be situated at or near the surface of the second softenable layer most distant from the substrate. Any other possible variations are also suitable.

As illustrated schematically in FIG. 1, migration imaging member 1 comprises in the order shown a substrate 4, an optional adhesive layer 5 situated on substrate 4, an optional charge blocking layer 7 situated on optional adhesive layer 5, an optional charge transport layer 9 situated on optional charge blocking layer 7, a first softenable layer 10 situated on optional charge transport layer 9, said first softenable layer 10 comprising first softenable material 11, optional first charge transport material 16, and first migration marking material 12 situated at or near the surface of the first softenable layer spaced from the substrate, and a second softenable layer 18 situated on first softenable layer 10 comprising second softenable material 19, optional second charge transport material 20, and second migration marking material 21 situated at or near the surface of second softenable layer 18 in contact with first softenable layer 10. Optional overcoating layer 17 is situated on the surface of the imaging member spaced from the substrate 4.

As illustrated schematically in FIG. 2, migration imaging member 2 comprises in the order shown a substrate 4, an optional adhesive layer 5 situated on substrate 4, an optional charge blocking layer 7 situated on optional adhesive layer 5, an optional charge transport layer 9 situated on optional charge blocking layer 7, a first softenable layer 10 situated on optional charge transport layer 9, said first softenable layer 10 comprising first softenable material 11, first optional charge transport material 16, and first migration marking material 12 situated at or near the surface of the first softenable layer spaced from the substrate, a second softenable layer 18 situated on first softenable layer 10 comprising second softenable material 19, optional second charge transport material 20, and second migration marking material 21 situated at or near the surface of second softenable layer 18 in contact with first softenable layer 10, and an infrared or red light radiation sensitive layer 13 situated on second softenable layer 18 comprising infrared or red light radiation sensitive pigment particles 14 optionally dispersed in polymeric binder 15. Alternatively (not shown), infrared or red light radiation sensitive layer 13 can comprise infrared or red light radiation sensitive pigment particles 14 directly deposited as a layer by, for example, vacuum evaporation techniques or other coating methods. Optional overcoating layer 17 is situated on the surface of the imaging member spaced from the substrate 4.

As illustrated schematically in FIG. 3, migration imaging member 3 comprises in the order shown a substrate 4, an optional adhesive layer 5 situated on substrate 4, an optional charge blocking layer 7 situated on optional adhesive layer 5, an infrared or red light radiation sensitive layer 13 situated on optional charge blocking layer 7 comprising infrared or red light radiation sensitive pigment particles 14 optionally dispersed in polymeric binder 15, an optional charge transport layer 9 situated on infrared or red light radiation sensitive layer 13, a first softenable layer 10 situated on optional charge transport layer 9, said first softenable layer 10 comprising first softenable material 11, first optional charge transport material 16, and first migration marking material 12 situated at or near the surface of the first softenable layer spaced from the substrate, and a second softenable layer 18 situated on first softenable layer 10 comprising second softenable material 19, optional second charge transport material 20, and second migration marking material 21 situated at or near the surface of second softenable layer 18 in contact with first softenable layer 10. Optional overcoating layer 17 is situated on the surface of imaging member 1 spaced from the substrate 4.

Any or all of the optional layers and materials shown in FIGS. 1, 2, and 3 can be absent from the imaging member. In addition, the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442, (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer, a substrate such as polyester coated with another conductive material, such as a conductive oxide, including oxides of tin, indium, or the like, metallic microfibers in a polymer binder, copper iodide, or the like, or any other layer situated between the substrate and the softenable layer. The substrate has any effective thickness, typically from about 6 to about 250 microns, and preferably from about 50 to about 200 microns, although the thickness can be outside of this range.

The first and second softenable layers may be either of the same materials or of different materials, and can comprise one or more layers of softenable materials, which can be any suitable material, typically a plastic or thermoplastic material which is either heat softenable or soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration marking material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The first softenable layer can be of any effective thickness, typically from about 1 to about 30 microns, and preferably from about 2 to about 25 microns, although the thickness can be outside of this range. The second softenable layer can be of any effective thickness, typically from about 1 to about 30 microns, preferably from about 2 to about 25 microns, more preferably from about 1 to about 10 microns, and even more preferably from about 2 to about 5 microns, although the thickness can be outside of this range. The first and second softenable layers can be applied to the substrate by any suitable process. Typical coating processes include draw bar coating, spray coating, extrusion, dip coating, gravure roll coating, wire-wound rod coating, air knife coating, reverse roll coating, and the like. The softenable layers can also be added by a lamination process as described hereinbelow.

The softenable layers also contain migration marking material, which may be either the same or different in the first and second softenable layers. The migration marking material is electrically photosensitive or photoconductive. In embodiments of the present invention wherein an infrared or red light sensitive layer is also present in the imaging member, the migration marking material is sensitive to radiation at a wavelength other than that to which the infrared or red light sensitive pigment is sensitive; while the migration marking material may exhibit some photosensitivity in the wavelength to which the infrared or red light sensitive pigment is sensitive, it is preferred that photosensitivity in this wavelength range be minimized so that the migration marking material and the infrared or red light sensitive pigment exhibit absorption peaks in distinct, different wavelength regions. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is preferably present in the first softenable layer as a thin layer or monolayer of particles situated at or near the surface of the first softenable layer spaced from the substrate, although the migration marking material may also be dispersed throughout the first softenable layer. In the second softenable layer the migration marking material can be present either as a dispersion or as a monolayer of particles. Preferably, the migration marking material is present in both the first softenable layer and in the second softenable layer as a monolayer of particles because this configuration enables the highest possible $D_{max}$ values for the lowest mass of migration marking material, and may also enable very low $D_{min}$ values. In this embodiment, it is preferred that the monolayer of particles be situated in the first softenable layer at or near the surface spaced from the substrate, while the monolayer of particles in the second softenable layer can be situated at or near the surface of the second softenable layer in contact with the first softenable layer, or at or near the surface of the second softenable layer most distant from the substrate, or at any other location within the layer. Alternatively, either one or both of the softenable layers can contain dispersions of migration marking material. When present as particles, the particles of migration marking material preferably have an average diameter of up to 2 microns, and more preferably of from about 0.1 micron to about 1 micron. The layer of migration marking particles in the first softenable layer is situated at or near that surface of the first softenable layer spaced from or most distant from the substrate. Typically, the particles are situated at a distance of from about 0.01 micron to 0.1 micron from the layer surface, although the distance can be outside this range. Preferably, the particles are situated at a distance of from about 0.005 micron to about 0.2 micron from each other, and more preferably at a distance of from about 0.05 micron to about 0.1 micron from each other, the distance being measured between the closest edges of the particles, i.e. from outer diameter to outer diameter. The migration marking material contiguous to the outer surface of the softenable layer is present in any effective amount, preferably from about 2 percent to about 25 percent by total weight of the softenable layer, and more preferably from about 5 to about 20 percent by total weight of the softenable layer.

Examples of suitable migration marking materials include selenium, alloys of selenium with alloying components such as tellurium, arsenic, mixtures thereof, and the like, and any other suitable materials as disclosed, for example, in U.S. Pat. No. 3,975,195 and other U.S. patents directed to migration imaging members and incorporated herein by reference.

The migration marking particles can be included in the imaging members by any suitable technique. For example, a layer of migration marking particles can be placed at or just below the surface of a softenable layer by solution coating a substrate containing the softenable layer material, followed by heating the softenable material in a vacuum chamber to soften it, while at the same time thermally evaporating the migration marking material onto the softenable material in the vacuum chamber. Other techniques for preparing monolayers include cascade and electrophoretic deposition. An example of a suitable process for depositing migration marking material in the softenable layer is disclosed in U.S. Pat. No. 4,482,622, the disclosure of which is totally incorporated herein by reference.

One preferred method for preparing imaging members of the present invention entails preparing a portion of the imaging member comprising the substrate and, coated thereon, the first softenable layer comprising the first softenable material, first migration marking material, and optional first charge transport material. The second softenable layer comprising the second softenable material, second migration marking material, and optional second charge transport material is coated onto a support, optionally coated with a release agent. This support can be of any suitable material, such as paper, polyester or other polymeric films, or the like. It is preferred for the support to be of minimum thickness to enable greatest possible surface area of the support coated with the second softenable material for a roll of given diameter of the coated support; minimum thickness of the support is also preferred for cost and recycling purposes. The optional release agent controls or reduces adhesion between the support and the second softenable layer. Examples of suitable release agents include long-chain alkyl derivatives, natural products, synthetic polymers, fluorinated compounds, inorganic materials, and the like. Silicone release agents are common. In some instances, the release agent is cured by exposure to ultraviolet light. Fluorocarbons such as polytetrafluoroethylene are also available but are relatively expensive. Highly cross-linked thermoset materials are also suitable release materials. When the second migration marking material is to be added to the second softenable layer by a vacuum evaporation process, the second softenable material and optional second charge transport material are coated onto the support, followed by vacuum evaporation of the migration marking material onto the second softenable material to form the second softenable layer. The first and second softenable layers are then brought into contact with each other so that the first softenable material and second softenable material are in intimate contact. Heat and/or pressure and/or solvent vapors can be applied to the substrate and/or the support while the first and second softenable layers are in intimate contact, causing the first softenable layer to adhere to the second softenable layer. Thereafter, the support is removed from the second softenable layer.

Figure 4:
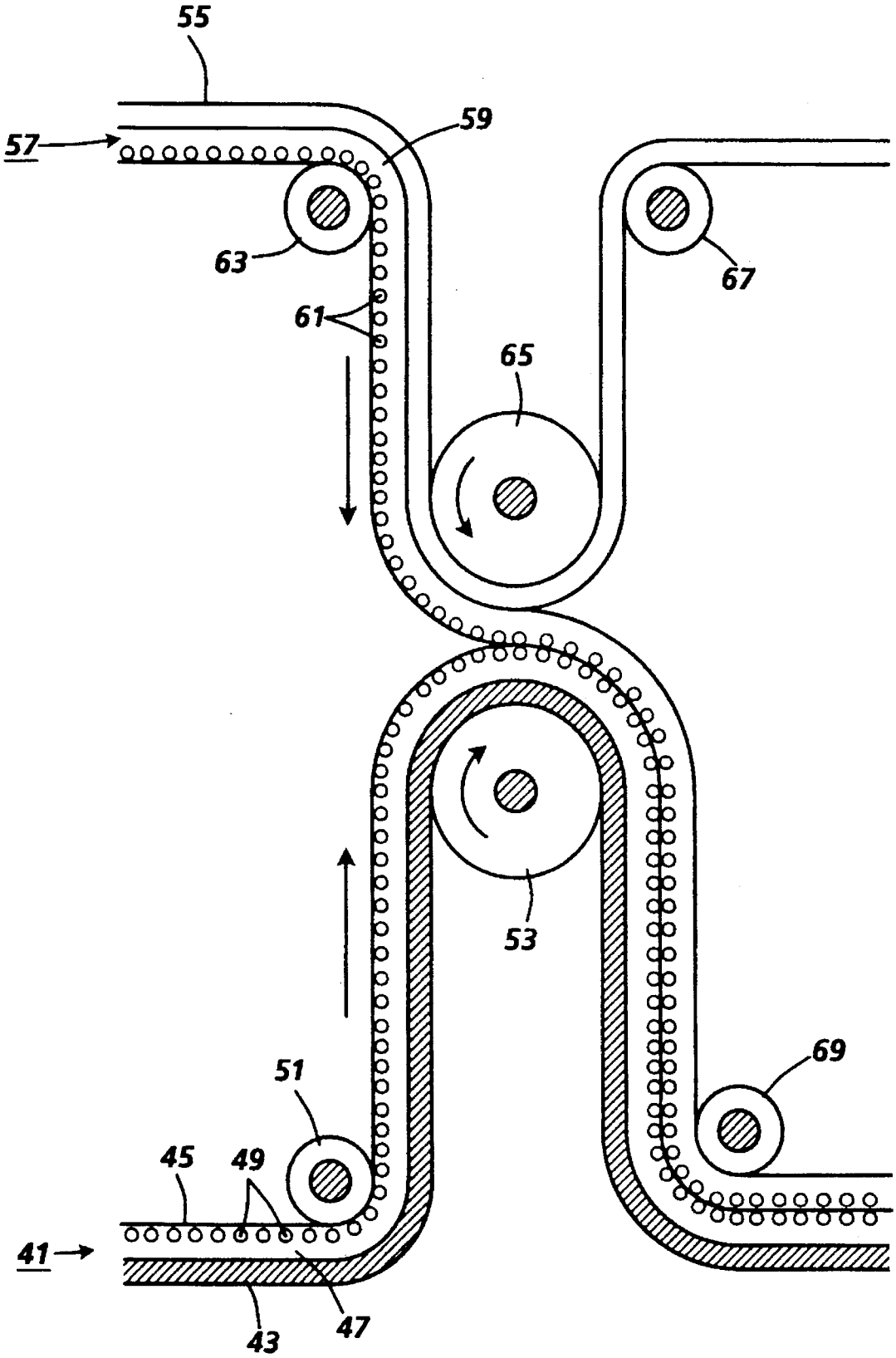
FIGS. 4 and 5 illustrate schematically portions of processes for preparing migration imaging members of the present invention.

As illustrated schematically in FIG. 4 (not drawn to scale), migration imaging member 41 comprising substrate 43 and first softenable layer 45, which comprises first softenable material 47 and first migration marking material 49, passes around optional idling roller 51 and then around roller 53. Support 55 has coated thereon second softenable layer 57, which comprises second softenable material 59 and second migration marking material 61. Support 55 bearing second softenable layer 57 passes around optional idling roller 63 and then around roller 65. Preferably, either one or both of rollers 53 and 65 are heated. Rollers 53 and 65 are situated with respect to each other so as to form a nip, such that pressure is applied to first softenable layer 45 and second softenable layer 57 while they are in intimate contact with each other. Thereafter, subsequent to exiting the nip formed by rollers 53 and 65, second softenable layer 57 adheres to first softenable layer 45 and support 55 is peeled away from second softenable layer 57. Support 55 then passes around optional idling roller 67 and the migration imaging member 41, which now comprises substrate 43, first softenable layer 45, and second softenable layer 57, then passes around optional idling roller 69. The temperature of rollers 53 and 65 and the pressure in the nip created by rollers 53 and 65 is selected so that second softenable layer 57 preferentially adheres to whichever layer is situated topmost on substrate 43 (which is first softenable layer 45 as illustrated in FIG. 4) subsequent to exiting the nip, and so that support 55 can be removed as cleanly as possible from second softenable layer 57, with little or no residual second softenable material 59 adhering to support 55 subsequent to exiting the nip. Preferred temperatures for rollers 53 and/or 65 typically are from about 80° C. to about 120° C., and more preferably from about 90° C. to about 110° C., although the temperature can be outside these ranges. Preferred pressures within the nip between rollers 53 and 65 typically are from about 0.1 pound per square inch to about 80 pounds per square inch, although the pressure can be outside this range. In one specific embodiment of the present invention, roller 53 is heated to a temperature of about 200° to 230° F., roller 63 is not heated, and the pressure created between roller 53 and roller 65 is about 60 pounds per square inch. In embodiments wherein both rollers 53 and 65 are heated, they can be heated either to the same temperature or to different temperatures.

Figure 5:
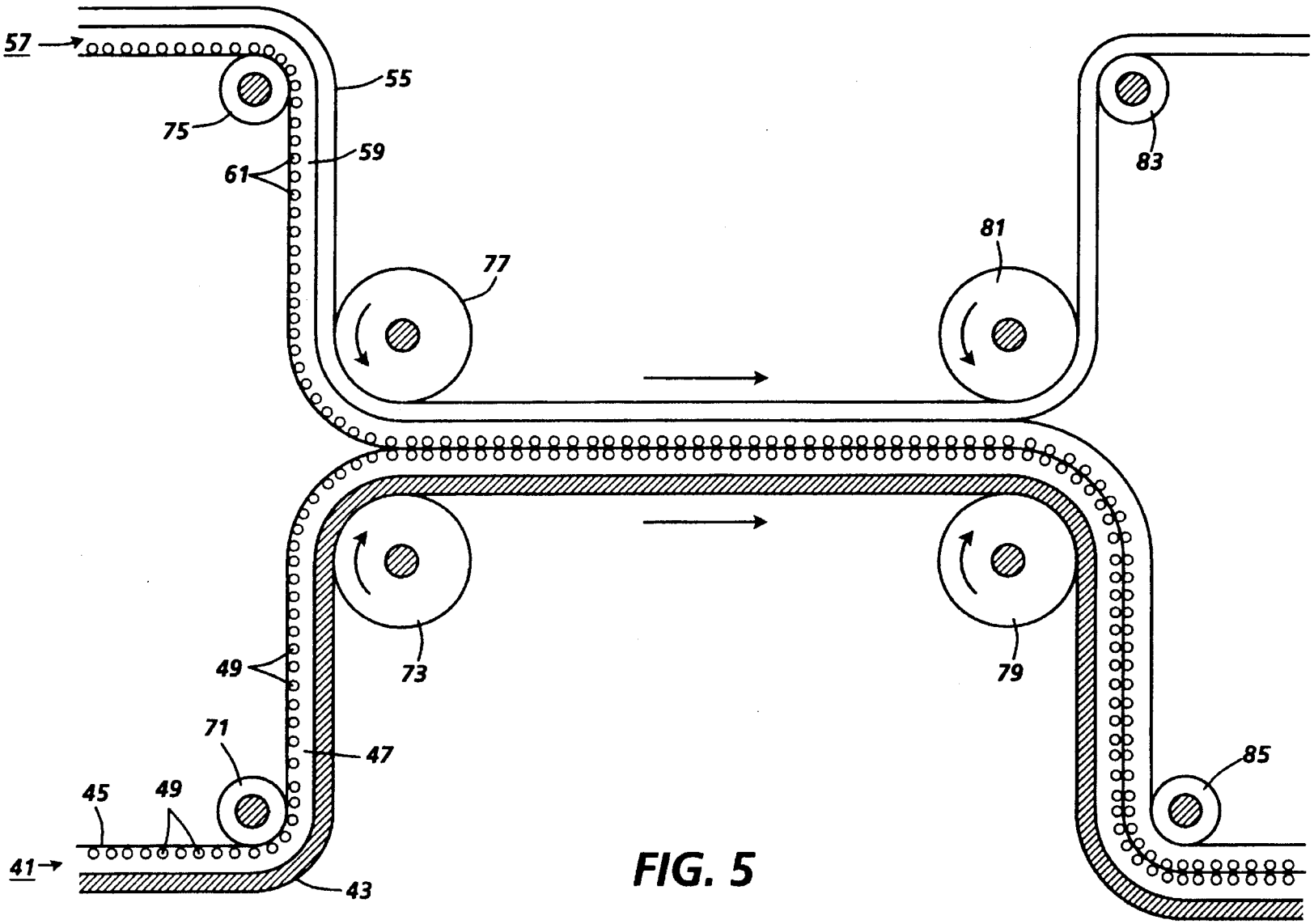

Alternatively, as illustrated schematically in FIG. 5 (not drawn to scale), migration imaging member 41 comprising substrate 43 and first softenable layer 45, which comprises first softenable material 47 and first migration marking material 49, passes around optional idling roller 71 and then around roller 73. Support 55 has coated thereon second softenable layer 57, which comprises second softenable material 59 and second migration marking material 61. Support 55 bearing second softenable layer 57 passes around optional idling roller 75 and then around roller 77. Preferably, either one or both of rollers 73 and 77 are heated. Rollers 73 and 77 are situated with respect to each other so as to form a nip, such that pressure is applied to first softenable layer 45 and second softenable layer 57 while they are in intimate contact with each other. Thereafter, subsequent to exiting the nip formed by rollers 73 and 77, second softenable layer 57 adheres to first softenable layer 45. The "sandwich" created by, in the order shown, substrate 43, first softenable layer 45, second softenable layer 57, and support 55 continues moving and enters the nip created between rollers 79 and 81, either or both of which may or may not be heated. Subsequent to exiting the nip formed by rollers 79 and 81, support 55 is peeled away from second softenable layer 57. Support 55 then passes around optional idling roller 83 and the migration imaging member 41, which now comprises substrate 43, first softenable layer 45, and second softenable layer 57, then passes around optional idling roller 85. The temperature of rollers 73 and 77 and the pressure in the nip created by rollers 73 and 77 is selected so that second softenable layer 57 preferentially adheres to whichever layer is situated topmost on substrate 43 (which is first softenable layer 45, as shown in FIG. 5) subsequent to exiting the nip. The temperature of rollers 79 and 81 and the pressure in the nip created by rollers 79 and 81 is selected so that support 55 can be removed as cleanly as possible from second softenable layer 57, with little or no residual second softenable material 59 adhering to support 55 subsequent to exiting the nip. Preferred temperatures for both sets of rollers typically are from about 80° C. to about 120° C., and more preferably from about 90° C. to about 110° C., although the temperature can be outside these ranges. Preferred pressures within the nips between both sets of rollers typically are from about 0.1 pound per square inch to about 80 pounds per square inch, although the pressure can be outside this range. This embodiment is particularly preferred when the materials selected for the first softenable layer, second softenable layer, support, and optional release material situated between the support and the second softenable layer are such that the optimum temperature and/or pressure for effecting adhesion between the first softenable layer and the second softenable layer is different from the optimum temperature and/or pressure for effecting separation of the support from the second softenable layer. With respect to rollers 73 and 77, one or both rollers may be heated to either the same temperature or to different temperatures. Similarly with respect to rollers 79 and 81, one or both rollers may be heated to either the same temperature or to different temperatures The rollers can be heated by any suitable method. For example, the rollers can have hollow cores and a heated liquid, such as oil, water, or the like, can be circulated through the cores. A heater can also be situated inside of the heated roller. Any of the methods known for heating fuser rolls in electrophotographic imaging devices can also be employed to heat the rollers. One or both of the softenable layers can also be heated by any desired method, such as exposure to radiation, illumination, or the like.

Typically, in the processes illustrated in FIGS. 4 and 5, the imaging member passes between the rollers at speeds of from about 30 to about 300 feet per minute, although the speed can be outside this range.

If desired, a third softenable layer containing a third softenable material and a third migration material, which may be the same as or different from the materials in the first and second softenable layers, can be added to the imaging member, as well as additional softenable layers as desired.

Alternatively (not shown), both the first softenable layer and the second softenable layer can be coated onto supports optionally coated with a release agent. The first and second softenable layers can then be laminated to each other as described above, followed first by removal of one of the supports and lamination of the first layer-second layer laminate to another layer within the imaging member structure, such as the substrate, and then secondly followed by removal of the other support and, if desired, subsequent lamination of the surface of the first layer-second layer laminate thus exposed to another layer within the imaging member structure, such as an infrared or red-light sensitive layer. Layers of the imaging member can thus be applied to each other by solvent coating processes, lamination processes, or any other suitable process.

When present, the infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. In another embodiment, the infrared or red light sensitive pigment can be dispersed within the softenable material of one of the softenable layers. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as RE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinylformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins Co., St. Louis, Mo., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Typically, the infrared or red light sensitive layer comprises the binder in an amount of from about 40 to about 90 percent by weight and the pigment in an amount of from about 10 to about 60 percent by weight, although the relative amounts can be outside this range. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional process. Typical coating processes include draw bar coating, spray coating, extrusion, dip coating, gravure roll coating, wire-wound rod coating, air knife coating, reverse roll coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can also be applied by a lamination process. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside this range. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside this range.

The migration imaging members may contain a charge transport material in one or both of the softenable layers and may also contain a charge transport material in an optional separate charge transport layer. The charge transport material can be any suitable charge transport material. The charge transport material can be either a hole transport material (transports positive charges) or an electron transport material (transports negative charges). The sign of the charge used to sensitize the migration imaging member during preparation of the master can be of either polarity. Charge transporting materials are well known in the art. Typical charge transporting materials include the following:

Diamine transport molecules of the type described in U.S. Pat. No. 4,306,008, U.S. Pat. No. 4,304,829, U.S. Pat. No. 4,233,384, U.S. Pat. No. 4,115,116, U.S. Pat. No. 4,299,897, and U.S. Pat. No. 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'- diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851, the disclosures of each of which are totally incorporated herein by reference. Typical pyrazoline transport molecules include 1-[lepidyl-(2)]3-(p-diethylaminophenyl)5-(p-diethylaminophenyl)pyrazoline, 1-[quinolyl-(2)]-3-(p-diethylaminophenyl)5-(p-diethylaminophenyl)pyrazoline, 1-[pyridyl-(2)]3-(p-diethylaminostyryl)5-(p-diethylaminophenyl)pyrazoline, 1-[6-methoxypyridyl-(2)]3-(p-diethylaminostyryl)-5-(p-diethylaminophenyl) pyrazoline, 1-phenyl-3-[p-dimethylaminostyryl]5-(p-dimethylaminostyryl)pyrazoline, 1-phenyl3-[p-diethylaminostyryl]5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260 and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. No. 4,150,987, U.S. Pat. No. 4,385,106, U.S. Pat. No. 4,338,388, and U.S. Pat. No. 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl-)methane, and cycloalkenyl-bis(N,N-dialkylaminoaryl-)methane as described in U.S. Pat. No. 3,820,989, the disclosure of which is totally incorporated herein by reference.

9-Fluorenylidene methane derivatives having the formula

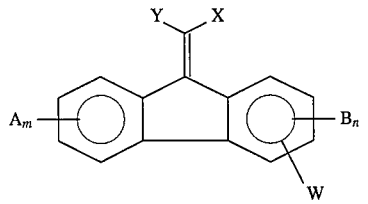

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)malononitrile, (4-phenethoxycarbonyl-9-fluorenylidene)malononitrile, (4-carbitoxy-9-fluorenylidene)malononitrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substituted polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6 -trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

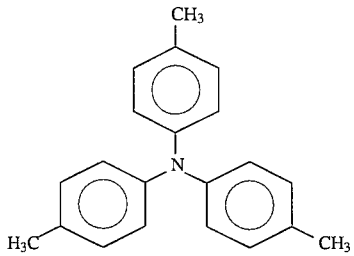

and the like, as disclosed in, for example, U.S. Pat. No. 3,240,597 and U.S. Pat. No. 3,180,730, the disclosures of which are totally incorporated herein by reference, and substituted diarylmethane and triarylmethane compounds, including bis-(4-diethylamino2-methylphenyl)phenylmethane, of the formula

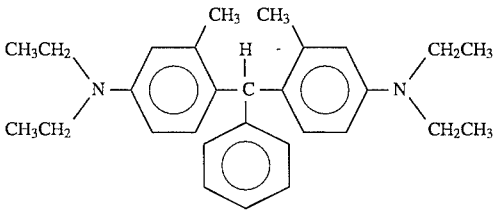

and the like, as disclosed in, for example, U.S. Pat. No. 4,082,551, U.S. Pat. No. 3,755,310, U.S. Pat. No. 3,647,431, British Patent 984,965, British Patent 980,879, and British Patent 1,141,666, the disclosures of which are totally incorporated herein by reference.

In embodiments of the present invention wherein an infrared-sensitive layer is also present in the imaging member, at least one softenable layer generally contains a charge transport material, and preferably at least the layer situated closest to the substrate toward which the migration marking material will migrate (i.e., the first softenable layer as illustrated in FIGS. 2 and 3) contains a charge transport material.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

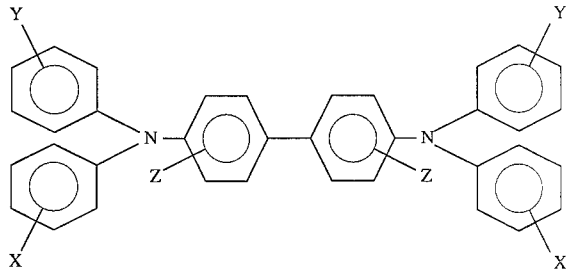

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. Excellent results can be obtained when the softenable layer containing a charge transport material contains from about 8 percent to about 40 percent by weight of these diamine compounds based on the total weight of the softenable layer. Optimum results are achieved when the softenable layer containing a charge transport material contains from about 16 percent to about 32 percent by weight of N,N'-diphenyl-N,N'-bis(3"-methylphenyl)-(1,1'-biphenyl)-4,4'-diamine based on the total weight of the softenable layer.

The charge transport material can be present in the softenable material in any effective amount, generally from about 5 to about 50 percent by weight and preferably from about 8 to about 40 percent by weight. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like. The charge transport material can also be incorporated into the softenable material, followed by coating the charge transport molecule and softenable layer mixture onto a release layer and subsequently laminating the softenable material containing the charge transport molecule to the substrate or to another layer in the migration imaging member, as described herein:

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the xeroprinting master making and xeroprinting steps of the present invention. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a substrate. Alternatively, a uniform deposit of electrostatic charge of suitable polarity on the exposed surface of the charge transport spacing layer can be substituted for a conductive substrate layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside of this range.

Charge transport molecules suitable for the charge transport layer are described in detail herein. The specific charge transport molecule utilized in the charge transport layer of any given imaging member can be identical to or different from any optional charge transport molecule employed in the softenable layer. Similarly, the concentration of the charge transport molecule utilized in the charge transport spacing layer of any given imaging member can be identical to or different from the concentration of any optional charge transport molecule employed in the softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside of this range. The charge transport material can be incorporated into the charge transport layer by similar techniques to those employed for the softenable layer.

The optional adhesive layer can include any suitable adhesive material. Typical adhesive materials include copolymers of styrene and an acrylate, polyester resin such as DuPont 49000 (available from E.I. du Pont & de Nemours Company), copolymer of acrylonitrile and vinylidene chloride, polyvinyl acetate, polyvinyl butyral and the like and mixtures thereof. The adhesive layer can have any effective thickness, typically from about 0.05 micron to about 1 micron, although the thickness can be outside of this range. When an adhesive layer is employed, it preferably forms a uniform and continuous layer having a thickness of about 0.5 micron or less to ensure satisfactory discharge during the xeroprinting process. It can also optionally include charge transport molecules.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 0.5 micron, and preferably from about 0.05 to about 0.1 micron, although the thickness can be outside of this range. Typical coating processes include draw bar coating, spray coating, extrusion, dip coating, gravure roll coating, wire-wound rod coating, air knife coating and the like. This layer can also be applied by lamination techniques as described herein.

The optional overcoating layer can be substantially electrically insulating, or have any other suitable properties. The overcoating preferably is substantially transparent, at least in the spectral region where electromagnetic radiation is used for imagewise exposure step in the master making process and for the uniform exposure step in the xeroprinting process. The overcoating layer is continuous and preferably of a thickness of up to about 1 to 2 microns. More preferably, the overcoating has a thickness of from about 0.1 micron to about 0.5 micron to minimize residual charge buildup. Overcoating layers greater than about 1 to 2 microns thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling, master making, and xeroprinting. The overcoating layer preferably adheres strongly to the softenable layer to minimize damage. The overcoating layer can also have adhesive properties at its outer surface which provide improved resistance to toner filming during toning, transfer, and/or cleaning. The adhesive properties can be inherent in the overcoating layer or can be imparted to the overcoating layer by incorporation of another layer or component of adhesive material. These adhesive materials should not degrade the film forming components of the overcoating and preferably have a surface energy of less than about 20 ergs/cm$^2$. Typical adhesive materials include fatty acids, salts and esters, fluorocarbons, silicones, and the like. The coatings can be applied by any suitable technique such as draw bar, spray, dip, melt, extrusion, and gravure coating, vacuum coating, or the like. It will be appreciated that these overcoating layers protect the imaging member before imaging, during imaging, after the members have been imaged, and during xeroprinting if it is used as a xeroprinting master.

If an optional overcoating layer is used on top of the softenable layer to improve abrasion resistance and if solvent softening is employed to effect migration of the migration marking material through the softenable material, the overcoating layer should be permeable to the vapor of the solvent used and additional vapor treatment time should be allowed so that the solvent vapor can soften the softenable layer sufficiently to allow the light-exposed migration marking material to migrate towards the substrate in image configuration. Solvent permeability is unnecessary for an overcoating layer if heat is employed to soften the softenable layer sufficiently to allow the exposed migration marking material to migrate towards the substrate in image configuration.

Further information concerning the structure, materials, and preparation of migration imaging members is disclosed in U.S. Pat. No. 3,975,195, U.S. Pat. No. 3,909,262, U.S. Pat. No. 4,536,457, U.S. Pat. No. 4,536,458, U.S. Pat. No. 4,013,462, U.S. Pat. No. 4,883,731, U.S. Pat. No. 4,123,283, U.S. Pat. No. 4,853,307, U.S. Pat. No. 4,880,715, U.S. application Ser. No. 590,959 (abandoned, filed Oct. 31, 1966), U.S. application Ser. No. 695,214 (abandoned, filed Jan. 2, 1968), U.S. application Ser. No. 000,172 (abandoned, filed Jan. 2, 1970), and P. S. Vincett, G. J. Kovacs, M. C.

Tam, A. L. Pundsack, and P. H. Soden, *Migration Imaging Mechanisms, Exploitation, and Future Prospects of Unique Photographic Technologies, XDM and AMEN,* Journal of Imaging Science 30 (4) July/August, pp. 183–191 (1986), the disclosures of each of which are totally incorporated herein by reference.

The migration imaging member of the present invention is imaged and developed to provide an imagewise pattern on the member. The imaged member can be used as an information recording and storage medium, for viewing and as a duplicating film, as a mask for exposing photosensitive lithographic printing plates, as a xeroprinting master in a xeroprinting process, or for any other desired purpose.

Figure 6:
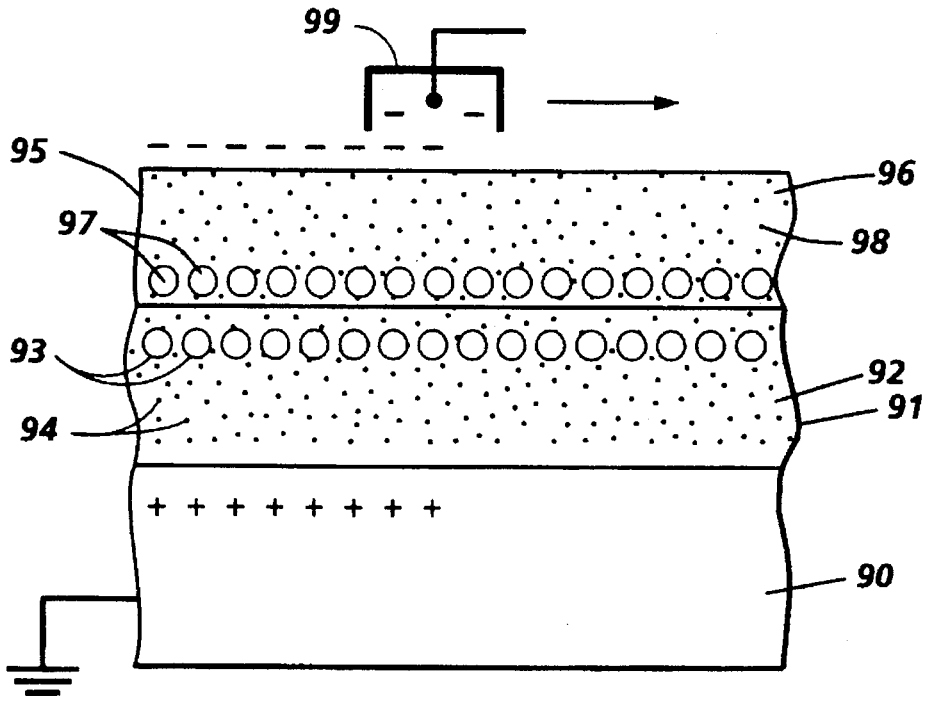
FIGS. 6, 7, and 8 illustrate schematically processes for imaging and developing a migration imaging member of the present invention.
Figure 7:
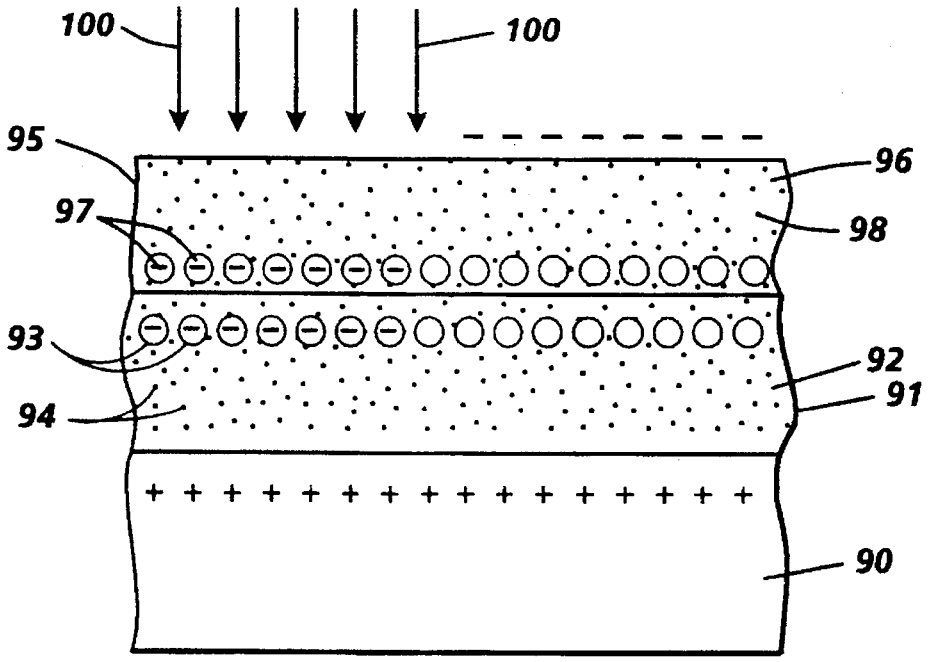
Figure 8:
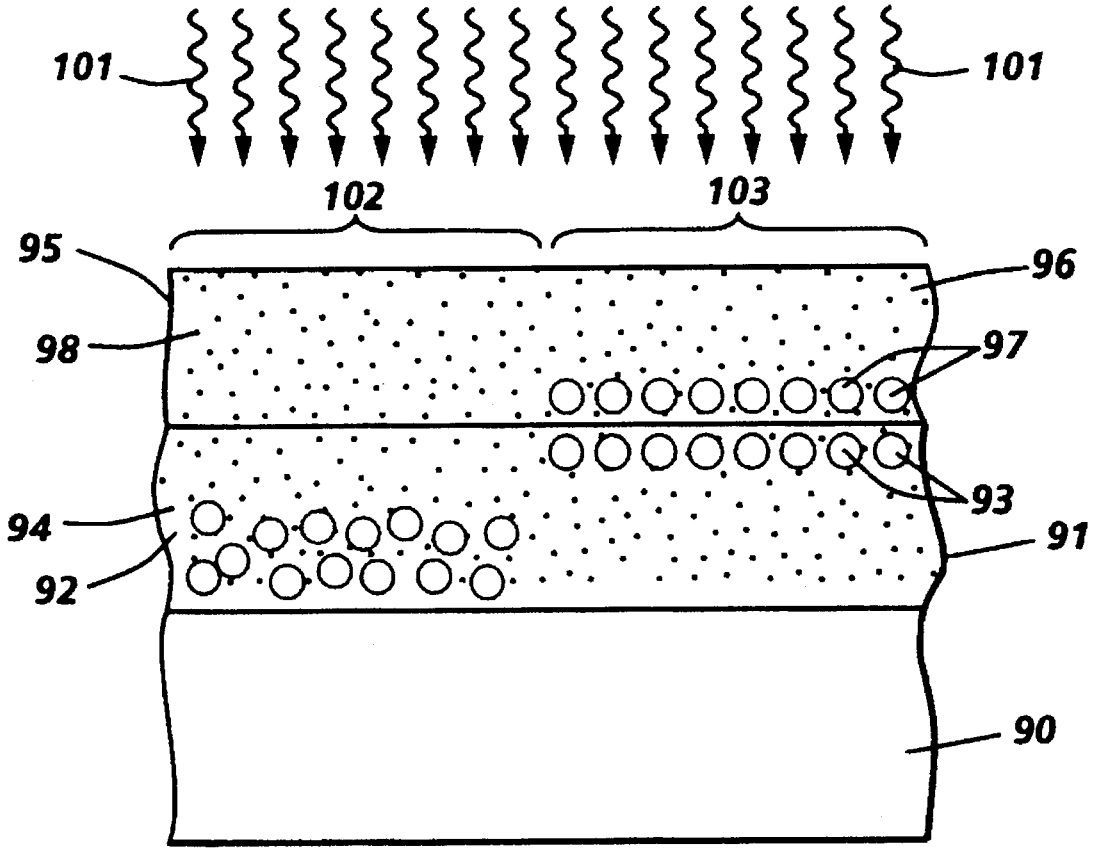

The process for imaging an imaging member of the present invention as shown schematically in FIG. 1 is illustrated schematically in FIGS. 6, 7, and 8. FIGS. 6, 7, and 8 illustrate schematically a migration imaging member comprising a conductive substrate layer 90 that is connected to a reference potential such as a ground, a first softenable layer 91 comprising first softenable material 92, first migration marking material 93, and optional first charge transport material 94, and a second softenable layer 95 comprising second softenable material 96, second migration marking material 97, and optional second charge transport material 98. As illustrated schematically in FIG. 6, the member is uniformly charged in the dark to either polarity (negative charging is illustrated in FIG. 6) by a charging means 99 such as a corona charging apparatus.

As illustrated schematically in FIG. 7, the charged member is then exposed imagewise to radiation 100 at a wavelength to which the migration marking materials 93 and 97 are sensitive. For example, when the first and second migration marking materials are both selenium particles, blue or green light can be used for imagewise exposure. Substantial photodischarge then occurs in the exposed areas.

As illustrated schematically in FIG. 8, subsequent to formation of a charge image pattern, the imaging member is developed by causing the first and second softenable materials to soften by any suitable means (in FIG. 8, by uniform application of heat energy 101 to the member). The heat development temperature and time depend upon factors such as how the heat energy is applied (e.g. conduction, radiation, convection, and the like), the melt viscosity of the softenable layers, thickness of the softenable layers, the amount of heat energy, and the like. For example, at a temperature of 110° C. to about 130° C., heat need only be applied for a few seconds. For lower temperatures, more heating time can be required. When the heat is applied, the first and second softenable materials decrease in viscosity, thereby decreasing their resistance to migration of the marking materials 93 and 97 through the softenable layers 91 and 95. As shown in FIG. 8, in areas 102 of the imaging member, wherein the migration marking materials have a substantial net charge, upon softening of the softenable layers 91 and 95, the net charge causes the charged marking material to migrate in image configuration towards the conductive layer 90 and disperse in the first softenable layer 91, resulting in a $D_{min}$ area. The uncharged migration marking particles in areas 103 of the imaging member remain essentially neutral and uncharged. Thus, in the absence of migration force, the unexposed migration marking particles remain substantially in their original position in softenable layers 91 and 95, resulting in a $D_{max}$ area.

If desired, solvent vapor development can be substituted for heat development. Vapor development of migration imaging members is well known in the art. Generally, if solvent vapor softening is utilized, the solvent vapor exposure time depends upon factors such as the solubility of the softenable layers in the solvent, the type of solvent vapor, the ambient temperature, the concentration of the solvent vapors, and the like.

The application of either heat, or solvent vapors, or combinations thereof, or any other suitable means should be sufficient to decrease the resistance of the softenable materials of softenable layers 91 and 95 to allow migration of the migration marking materials 93 and 97 through softenable layers 91 and 95 in imagewise configuration. With heat development, satisfactory results can be achieved by heating the imaging member to a temperature of about 100° C. to about 130° C. for only a few seconds when the unovercoated softenable layers contain an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine. The test for a satisfactory combination of time and temperature is to maximize optical contrast density and electrostatic contrast potential for xeroprinting. With vapor development, satisfactory results can be achieved by exposing the imaging member to the vapor of toluene for between about 4 seconds and about 60 seconds at a solvent vapor partial pressure of between about 5 millimeters and 30 millimeters of mercury when the unovercoated softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine.

The imaging member illustrated in FIGS. 6, 7, and 8 is shown without any optional layers such as those illustrated in FIG. 1. If desired, alternative imaging member embodiments, such as those employing any or all of the optional layers illustrated in FIG. 1, can also be employed.

Figure 9A:
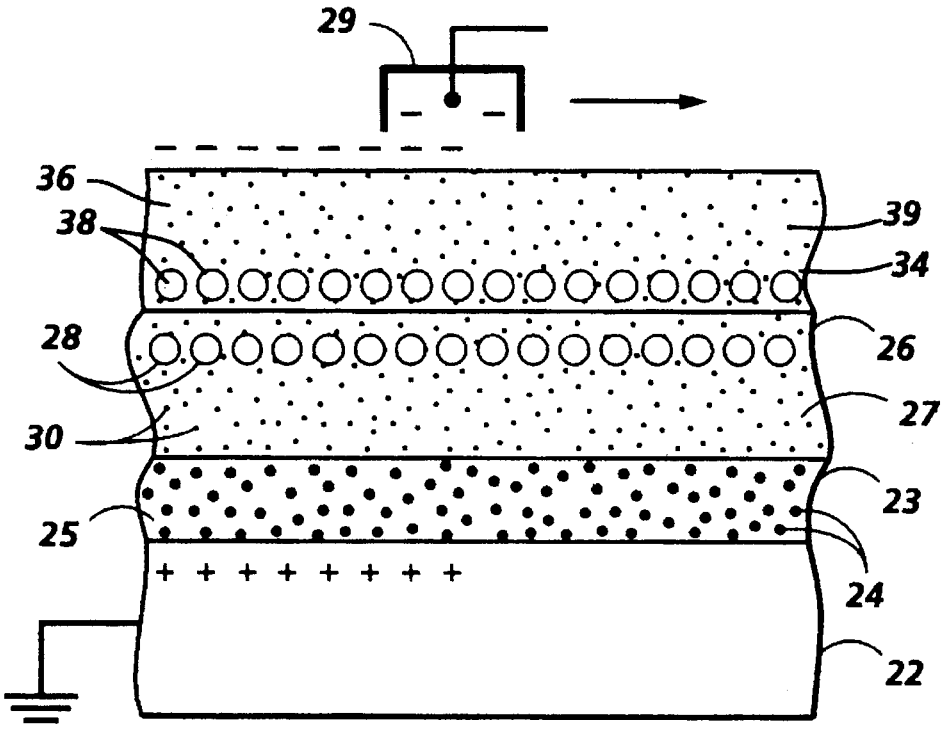
FIGS. 9A, 9B, 10A, 10B, 11A, 11B, 11C, 12A, 12B, 13A, 13B, 13C, 14A, and 14B illustrate schematically processes for imaging and developing migration imaging members of the present invention containing an infrared or red-light sensitive layer by imagewise exposure to infrared or red light.
Figure 9B:
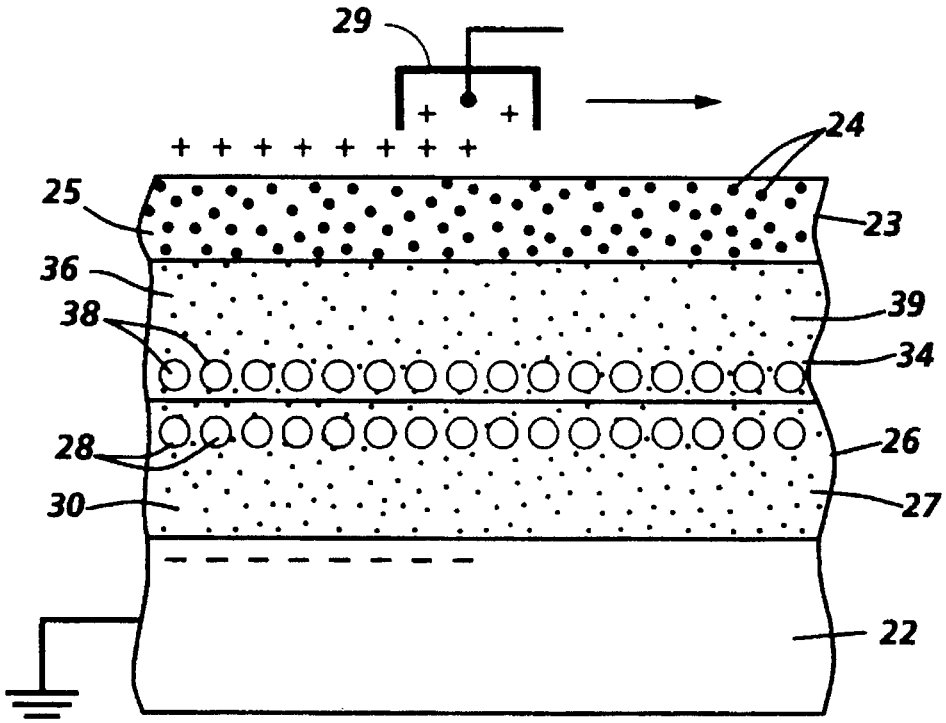

The process for imaging an imaging member of the present invention as shown schematically in FIG. 2 or FIG. 3 by imagewise exposure to infrared or red radiation and developing a migration imaging member of the present invention is illustrated schematically in FIGS. 9A and 9B through 14A and 14B. The process illustrated schematically in FIGS. 9B, 10B, 11B, 11C, 12B, 13B, 13C, and 14B represents an embodiment of the present invention wherein the first and second softenable layers are situated between the infrared or red light sensitive layer and the substrate and both of the softenable layers contain a charge transport material capable of transporting charges of one polarity. In the process steps illustrated in FIGS. 9B, 10B, 11B, 12B, and 13B, the imaging member is charged to the same polarity as that which the charge transport materials in the softenable layers are capable of transporting; in the process steps illustrated schematically in FIGS. 11C and 13C, the imaging member is recharged to the polarity opposite to that which the charge transport materials are capable of transporting. In FIGS. 9B, 10B, 11B, 11C, 12B, 13B, 13C, and 14B, the softenable materials in both softenable layers contain hole transport materials (capable of transporting positive charges). FIGS. 9A and 9B through 14A and 14B illustrate schematically a migration imaging member comprising a conductive substrate layer 22 that is connected to a reference potential such as a ground, an infrared or red light sensitive layer 23 comprising infrared or red light sensitive pigment particles 24 dispersed in polymeric binder 25, a first softenable layer 26 comprising first softenable material 27, first migration marking material 28, and first charge transport material 30, and a second softenable layer 34 comprising second softenable material 36, second migration marking material 38, and second charge transport material 39. As illustrated in FIGS. 9A and B, the member is uniformly charged in the dark to either polarity (negative charging is illustrated in FIG. 9A, positive charging is illustrated in FIG. 9B) by a charging means 29 such as a corona charging apparatus.

Figure 10A:
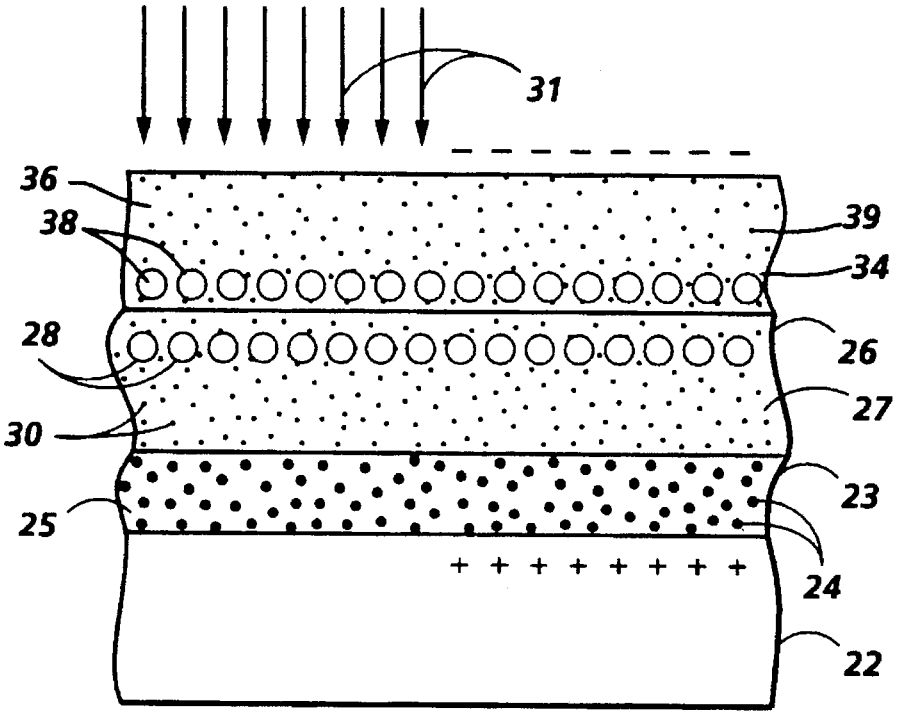
Figure 10B:
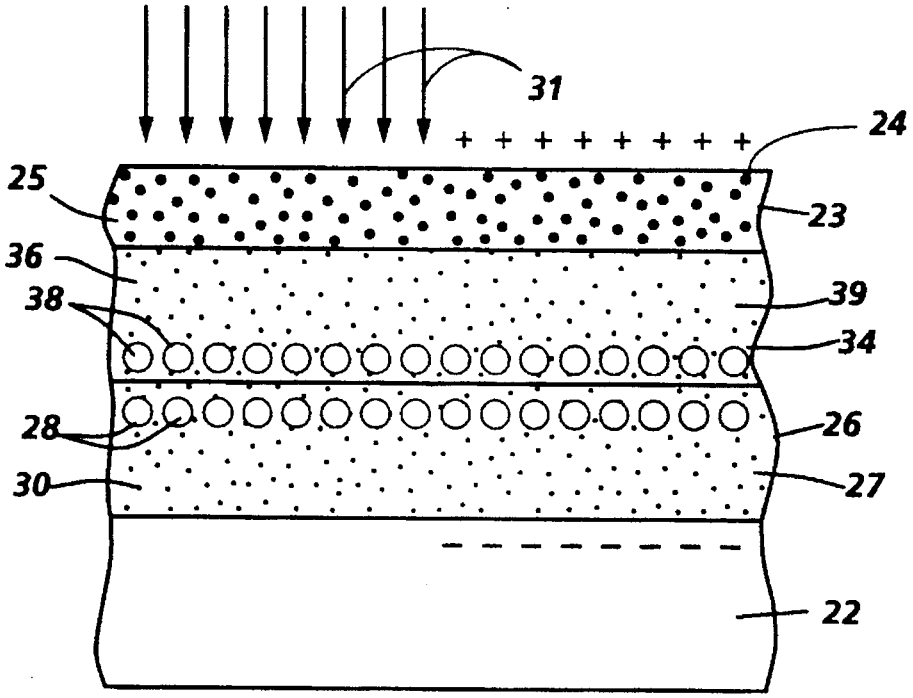

As illustrated schematically in FIGS. 10A and 10B, the charged member is first exposed imagewise to infrared or red light radiation 31. The wavelength of the infrared or red light radiation used is preferably selected to be in the region where the infrared or red-light sensitive pigments exhibit maximum optical absorption and maximum photosensitivity. When the softenable layers 26 and 34 are situated between the infrared or red light sensitive layer 23 and the radiation source 31, as shown in FIG. 10A, the infrared or red light radiation 31 passes through the non-absorbing migration marking material 28 and 38 (which are selected to be substantially insensitive to the infrared or red light radiation wavelength used in this step) and exposes the infrared or red light sensitive pigment particles 24 in the infrared or red light sensitive layer. Absorption of infrared or red light radiation by the infrared or red light sensitive pigment results in substantial photodischarge in the exposed areas. Thus the areas that are exposed to infrared radiation become substantially discharged. As shown in FIG. 10B, when the infrared or red light sensitive layer 23 is situated between the softenable layers 26 and 34 and the radiation source 31 and the member is charged to the same polarity as the charge transport materials in the softenable layers are capable of transporting, absorption of infrared or red light radiation by the infrared or red light sensitive pigment results in substantial photodischarge in the exposed areas. Thus the areas that are exposed to infrared radiation become substantially discharged.

Figure 11A:
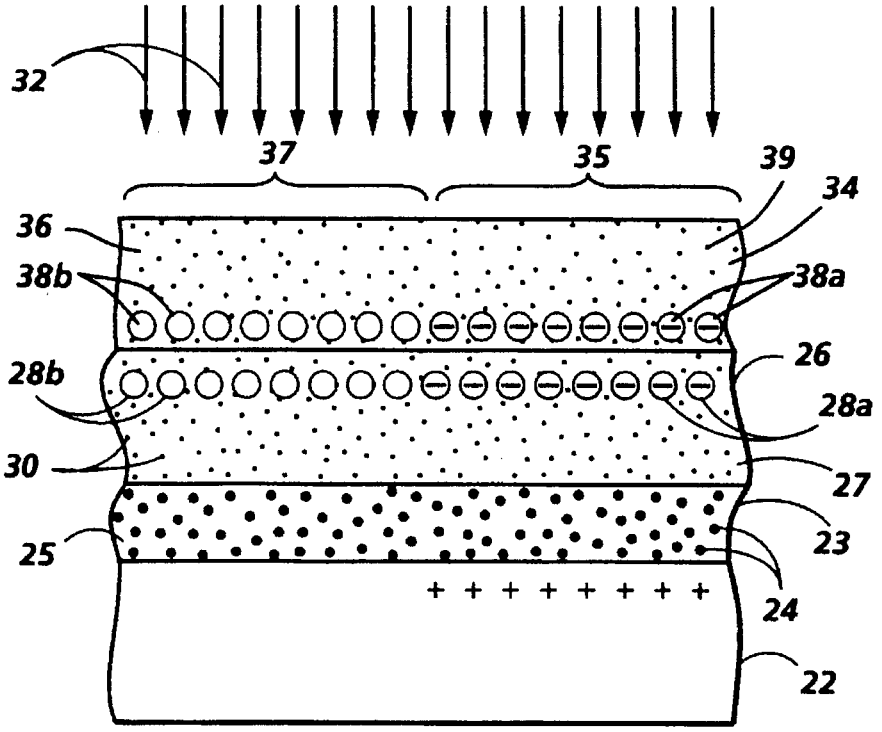
Figure 11B:
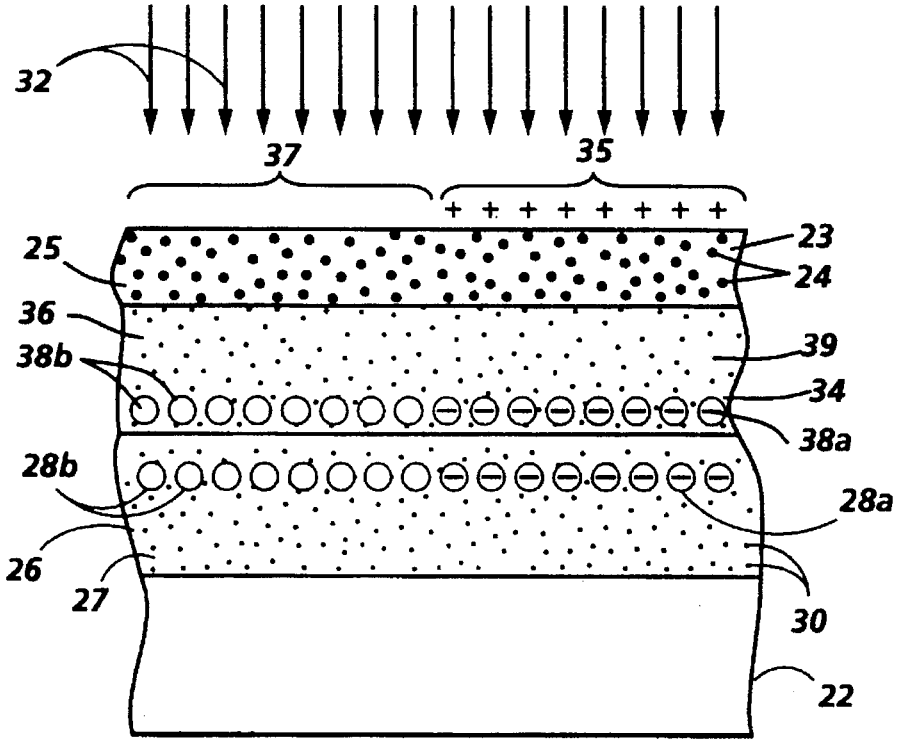

As illustrated schematically in FIGS. 11A and B, the charged member is subsequently exposed uniformly to activating radiation 32 at a wavelength to which the migration marking materials 28 and 38 are sensitive. For example, when both the first and second migration marking materials are selenium particles, blue or green light can be used for uniform exposure. As shown in FIG. 11A, when layers 26 and 34 are situated above layer 23, the uniform exposure to radiation 32 results in absorption of radiation by the migration marking materials 28 and 38. (In the context of the present invention, "above" with respect to the ordering of the layers within the migration imaging member indicates that the layer is relatively nearer to the radiation source and relatively more distant from the substrate, and "below" with respect to the ordering of the layers within the migration imaging member indicates that the layer is relatively more distant from the radiation source and relatively nearer to the substrate.) In charged areas of the imaging member 35, the migration marking particles 28*a* and 38*a* acquire a negative charge as ejected holes (positive charges) discharge the surface charges, resulting in an electric field between the migration marking particles and the substrate. Areas 37 of the imaging member that have been substantially discharged by prior infrared or red light exposure are no longer sensitive, and the migration marking particles 28*b* and 38*b* in these areas acquire no or very little charge. As shown in FIG. 11B, when the infrared or red light sensitive layer 23 is situated above the softenable layers 26 and 34 and the member is charged to the same polarity as the charge transport materials in the softenable layers are capable of transporting, uniform exposure to radiation 32 at a wavelength to which the migration marking materials 28 and 38 are sensitive is largely absorbed by the migration marking materials 28 and 38. The wavelength of the uniform light radiation is preferably selected to be in the region where the infrared or red-light sensitive pigments in layer 23 exhibit maximum light transmission and where the migration marking particles 28 and 38 exhibit maximum light absorption. Thus, in areas of the imaging member which are still charged, the migration marking particles 28*a* and 38*a* acquire a negative charge as ejected holes (positive charges) transport through the softenable layers to the substrate. Areas 37 of the imaging member that have been substantially discharged by prior infrared or red light exposure are no longer light sensitive, and the migration marking particles 28*b* and 38*b* in these areas acquire no or very little charge.

Figure 11C:
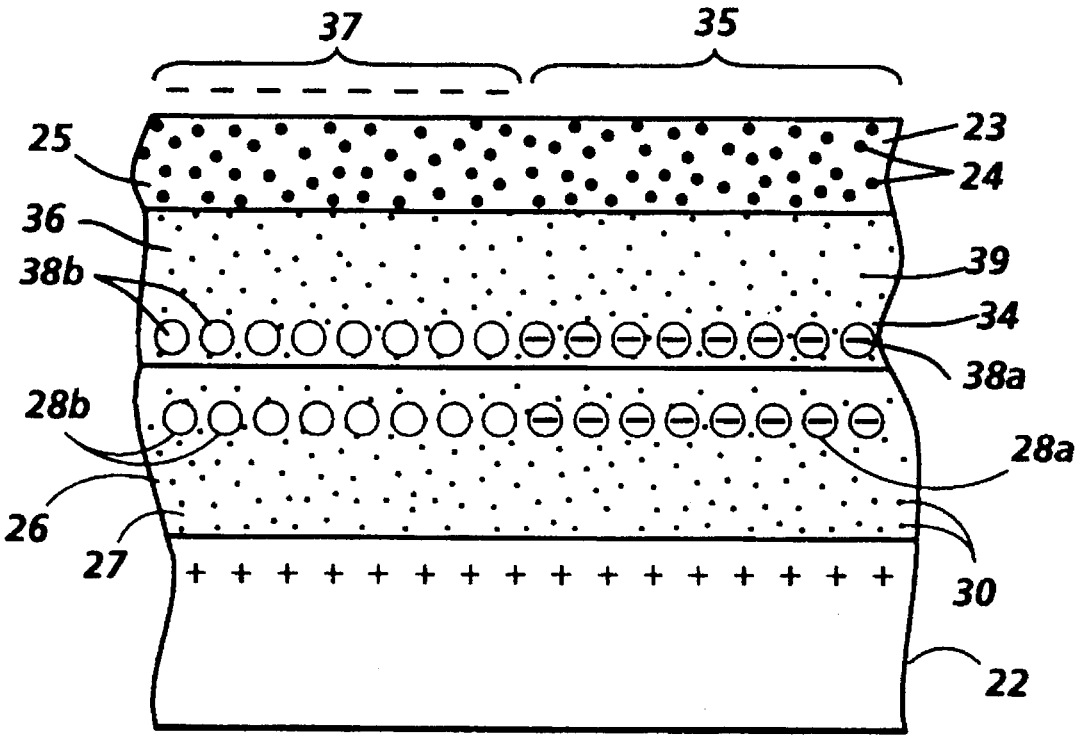

In the embodiment illustrated in FIG. 11B, the resulting charge pattern is such that the imaging member cannot be developed by heat development, since there is no substantial electric field between the migration marking materials and the substrate. The imaging member with a charge pattern as illustrated in FIG. 11B can be developed by a development process, such as solvent vapor exposure followed by heating, in which the non-charged particles agglomerate and coalesce into a few large particles, resulting in a $D_{min}$ region, and the non-charged particles, which repel each other because they bear like charges, are not agglomerated or coalesced and remain substantially in their original positions, resulting in a $D_{max}$ region, as disclosed in, for example, U.S. Pat. No. 4,880,715, the disclosure of which is totally incorporated herein by reference. Satisfactory results can be achieved with a vapor exposure time of between about 10 seconds and about 2 minutes at about 21° C., followed by heating to a temperature between about 80° C. and about 120° C. for from about 2 seconds to about 2 minutes and with solvent vapor partial pressures of between about 20 millimeters of mercury and about 80 millimeters of mercury when the solvent is methyl ethyl ketone and the softenable layer contains an 80/20 mole percent copolymer of styrene and hexylmethacrylate having an intrinsic viscosity of 0.179 deciliters per gram and N,N'-diphenyl-N,N'-bis(3"-methylphenyl)-(1,1'-biphenyl)-4,4'-diamine. However, heat development generally is preferred to vapor or solvent development for reasons of safety, speed, cost, simplicity, and easy implementation in a machine environment. As shown in FIG. 11C, the imaging member is further subjected to uniform recharging to a polarity opposite to that which the charge transport materials in the softenable layers are capable of transporting (negative as illustrated in FIG. 11C), resulting in the migration marking materials in areas of the imaging member which have not been exposed to infrared or red light radiation becoming negatively charged, with an electric field between the migration marking particles and the substrate, and areas of the imaging member previously exposed to infrared or red light radiation becoming charged only on the surface of the member.

It is important to emphasize that in general, the step of imagewise exposing the member to infrared or red light radiation and the step of uniformly exposing the member to radiation at a wavelength to which the migration marking material is sensitive can take place in any order. When the member is first imagewise exposed to infrared or red light radiation as illustrated in FIGS. 10A and 10B and subsequently uniformly exposed to radiation to which the migration marking materials are sensitive as illustrated in FIGS. 11A, 11B, and 11C, the process proceeds as described with respect to FIGS. 10A, 10B, 11A, 11B, and 11C. When the member is first uniformly exposed to radiation to which the migration marking materials are sensitive and subsequently imagewise exposed to infrared or red light radiation, the process proceeds as described with respect to FIGS. 12A, 12B, 13A, 13B, and 13C.

Figure 12A:
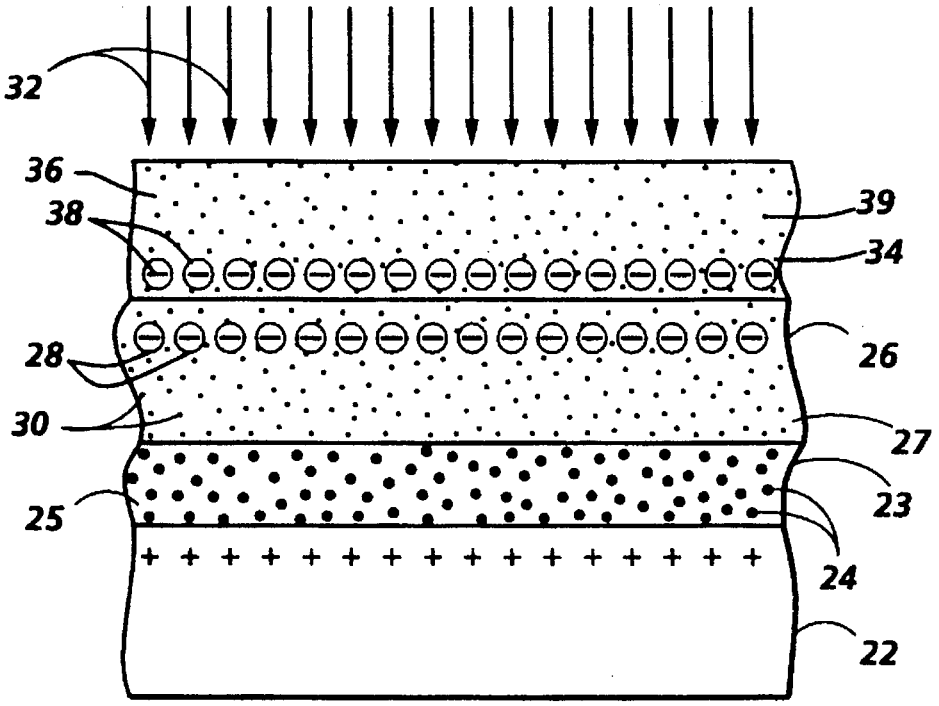
Figure 12B:
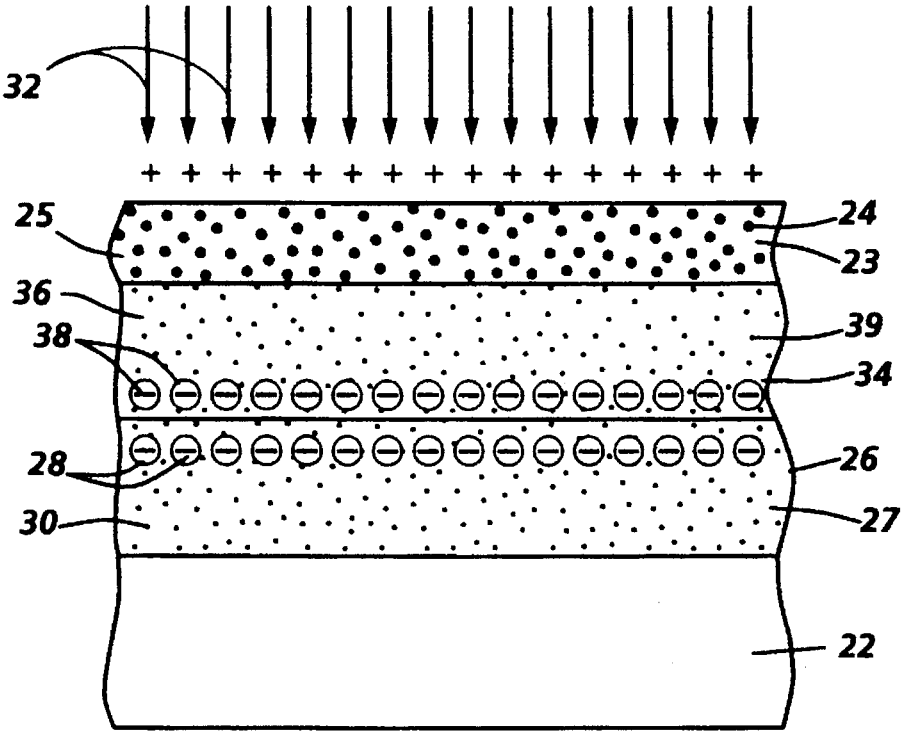

As illustrated schematically in FIGS. 12A and 12B, the charged member illustrated schematically in FIGS. 9A and 9B is first exposed uniformly to activating radiation 32 at a wavelength to which the migration marking materials 28 and 38 are sensitive. For example, when both the first and second migration marking materials are selenium particles, blue or green light can be used for uniform exposure. As shown in FIG. 12A, when layers 26 and 34 are situated above layer 23, the uniform exposure to radiation 32 results in absorption of radiation by the migration marking materials 28 and 38. The migration marking particles 28 and 38 acquire a negative charge as ejected holes (positive charges) discharge the surface negative charges. As shown in FIG. 12B, when layer 23 is situated above layers 26 and 34, uniform exposure to activating radiation 32 at a wavelength to which the migration marking materials are sensitive results in substantial photodischarge as the photogenerated charges (holes in this instance) in the migration marking particles are ejected out of the particles and transported to the substrate. As a result, the migration marking particles acquire a negative charge as shown schematically in FIG. 12B.

Figure 13A:
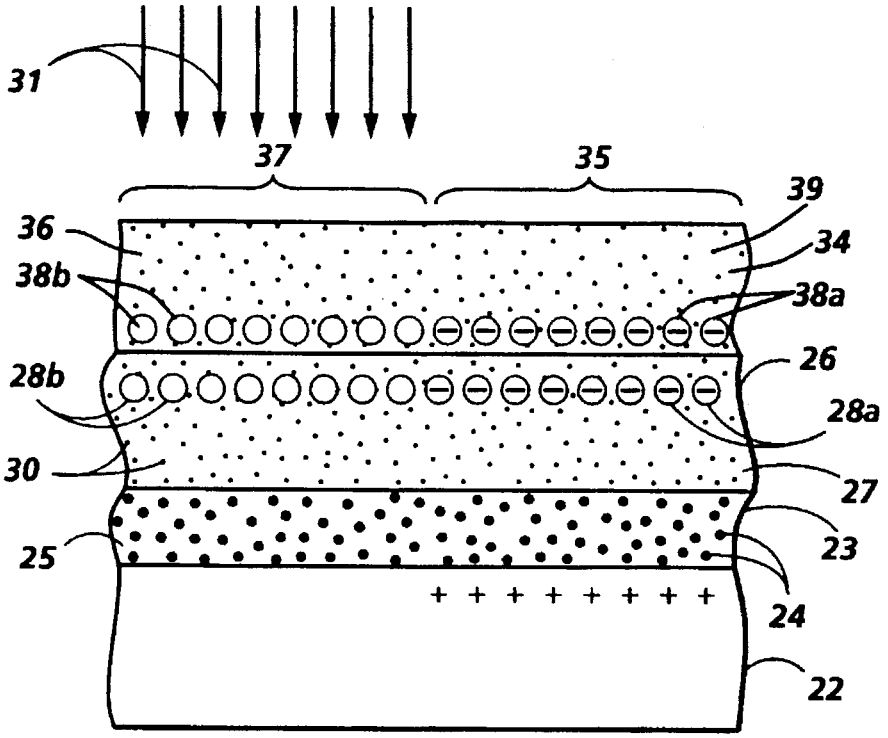
Figure 13B:
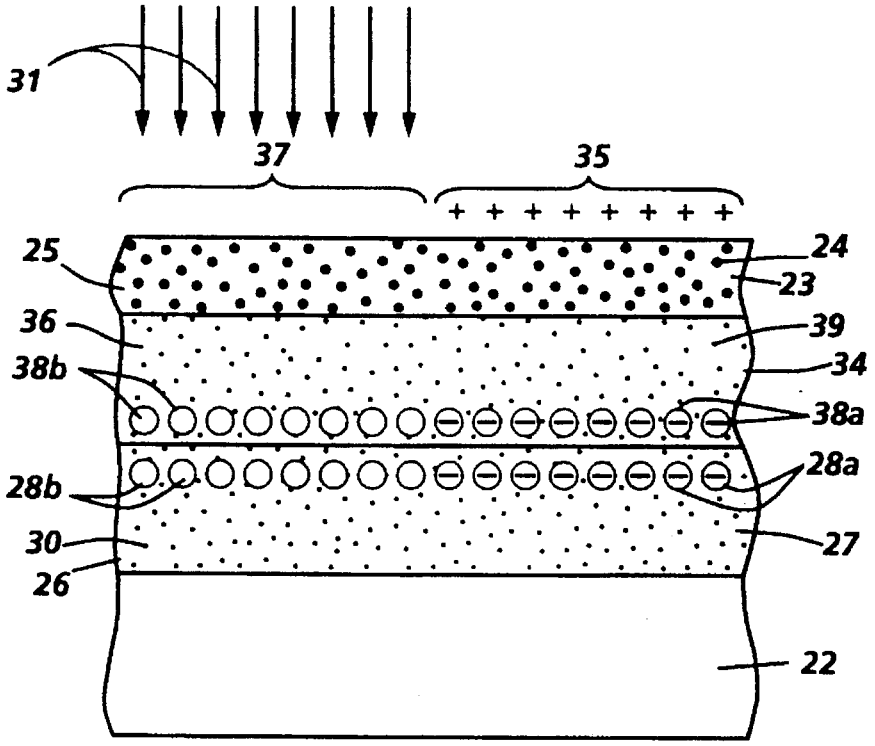
Figure 13C:
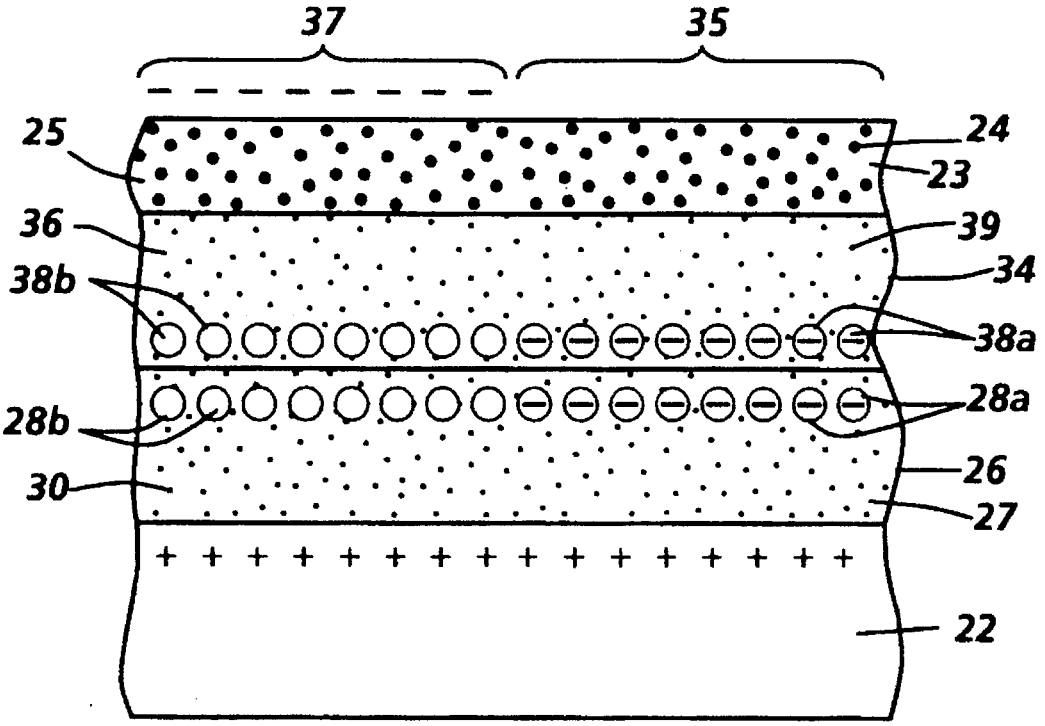

As illustrated schematically in FIGS. 13A, 13B, and 13C, the charged member is subsequently exposed imagewise to infrared or red light radiation 31. As shown in FIG. 13A, when the softenable layers 26 and 34 are situated between the infrared or red light sensitive layer 23 and the radiation source 31, the infrared or red light radiation 31 passes through the non-absorbing migration marking materials 28 and 34 (which are selected to be insensitive to the infrared or red light radiation wavelength used in this step) and exposes the infrared or red light sensitive pigment particles 24 in the infrared or red light sensitive layer, thereby discharging the migration marking particles 28*b* and 38*b* in area 37 that are exposed to infrared or red light radiation and leaving the migration marking particles 28*a* and 38*a* charged in areas 35 not exposed to infrared or red light radiation. As shown in FIG. 13B, when layer 23 is situated above layers 26 and 34, and the charged member is subsequently imagewise exposed to infrared or red light radiation 31, absorption of the infrared or red light by layer 23 in the exposed areas results in photogeneration of electrons and holes which neutralize the positive surface charge and the negative charge in the migration marking particles.

In the embodiment illustrated in FIG. 13B, the resulting charge pattern is such that the imaging member cannot be developed by heat development, since there is no substantial electric field between the migration marking materials and the substrate. The imaging member with a charge pattern as illustrated in FIG. 13B can be developed by a development process, such as solvent vapor exposure followed by heating, in which the non-charged particles agglomerate and coalesce into a few large particles, resulting in a $D_{min}$ region, and the non-charged particles, which repel each other because they bear like charges, are not agglomerated or coalesced and remain substantially in their original positions, resulting in a $D_{max}$ region. However, heat development generally is preferred to vapor or solvent development for reasons of safety, speed, cost, simplicity, and easy implementation in a machine environment. As shown schematically in FIG. 13C, the imaging member is further subjected to uniform recharging to a polarity opposite to that which the charge transport materials in the softenable layers are capable of transporting (negative as illustrated in FIG. 13C), resulting in the migration marking materials in areas of the imaging member which have not been exposed to infrared or red light radiation becoming negatively charged, with an electric field between the migration marking particles and the substrate, and areas of the imaging member previously exposed to infrared or red light radiation becoming charged only on the surface of the member. The charge image pattern obtained after the processes illustrated schematically in FIGS. 12A and 12B and FIGS. 13A, 13B, and 13C is thus identical to the one obtained after the processes illustrated schematically in FIGS. 10A and 10B and FIGS. 11A, 11B, and 11C.

Figure 14A:
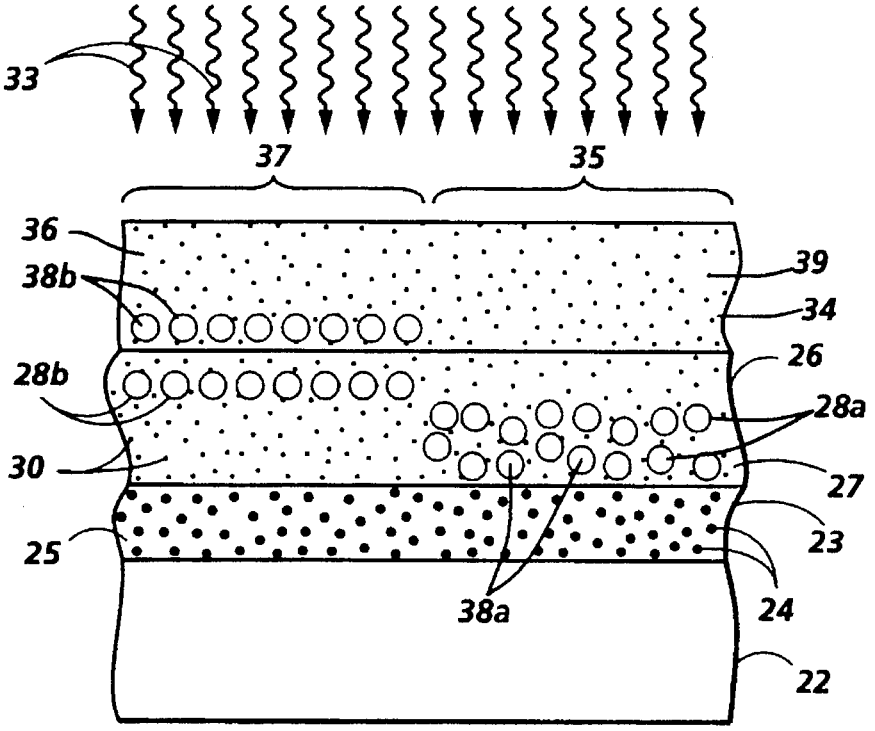
Figure 14B:
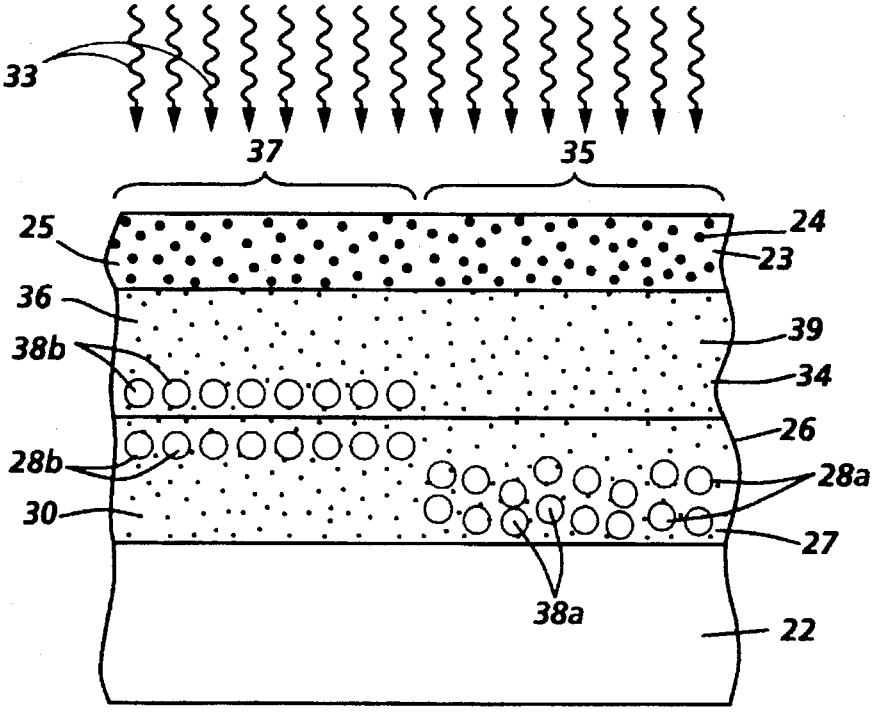

As illustrated schematically in FIGS. 14A and 14B, subsequent to formation of a charge image pattern, the imaging member is developed by causing the softenable materials to soften by any suitable means (in FIGS. 14A and 14B, by uniform application of heat energy 33 to the member). The heat development temperature and time depend upon factors such as how the heat energy is applied (e.g. conduction, radiation, convection, and the like), the melt viscosity of the softenable layers, thickness of the softenable layers, the amount of heat energy, and the like. For example, at a temperature of 110° C. to about 130° C., heat need only be applied for a few seconds. For lower temperatures, more heating time can be required. When the heat is applied, the softenable materials 27 and 36 decrease in viscosity, thereby decreasing their resistance to migration of the marking materials 28 and 38 through the softenable layers 26 and 34. As shown in FIG. 14A, when layers 26 and 34 are situated above layer 23, in areas 35 of the imaging member, wherein the migration marking materials 28*a* and 38*a* have a substantial net charge, upon softening of the softenable materials 27 and 36, the net charge causes the charged marking material to migrate in image configuration towards the conductive layer 22 and disperse or agglomerate in the first softenable layer 26, resulting in a $D_{min}$ area. The uncharged migration marking particles 28*b* and 38*b* in areas 37 of the imaging member remain essentially neutral and uncharged. Thus, in the absence of migration force, the unexposed migration marking particles remain substantially in their original position in softenable layers 26 and 34, resulting in a $D_{max}$ area. As shown in FIG. 14B, in the embodiment wherein layer 23 is situated above layers 26 and 34 and the member was charged in step 9B to the same polarity as that which the charge transport materials in the softenable layers are capable of transporting and in which the member has been recharged as shown in FIG. 11C or 13C to the polarity opposite to that which the charge transport materials in the softenable layers are capable of transporting, the migration marking particles that are charged (those not exposed to infrared or red light radiation) migrate in depth toward the substrate 22 and disperse or agglomerate in first softenable layer 26, resulting in a $D_{min}$ area. The uncharged migration marking particles 28*b* and 38*b* in areas 37 of the imaging member remain essentially neutral and uncharged. Thus, in the absence of migration force, the unexposed migration marking particles remain substantially in their original positions in softenable layers 26 and 34, resulting in a $D_{max}$ area.

If desired, solvent vapor development can be substituted for heat development. Vapor development of migration imaging members is well known in the art. Generally, if solvent vapor softening is utilized, the solvent vapor exposure time depends upon factors such as the solubility of the softenable layers in the solvent, the type of solvent vapor, the ambient temperature, the concentration of the solvent vapors, and the like.

The application of either heat, or solvent vapors, or combinations thereof, or any other suitable means should be sufficient to decrease the resistance of the softenable materials 27 and 36 of softenable layers 26 and 34 to allow migration of the migration marking materials 28 and 38 through softenable layers 26 and 34 in imagewise configuration. With heat development, satisfactory results can be achieved by heating the imaging member to a temperature of about 100° C. to about 130° C. for only a few seconds when the unovercoated softenable layers contain an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine. The test for a satisfactory combination of time and temperature is to maximize optical contrast density. With vapor development, satisfactory results can be achieved by exposing the imaging member to the vapor of toluene for between about 4 seconds and about 60 seconds at a solvent vapor partial pressure of between about 5 millimeters and 30 millimeters of mercury when the unovercoated softenable layers contain an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine.

The imaging members illustrated in FIGS. 9A and 9B through 14A and 14B are shown without any optional layers such as those illustrated in FIGS. 2 and 3. If desired, alternative imaging member embodiments, such as those employing any or all of the optional layers illustrated in FIGS. 2 and 3, can also be employed.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A

Three migration imaging members each having a single softenable layer were prepared as follows. A solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto three 3 mil thick polyester substrates (Melinex 442, obtained from Imperial Chemical Industries (ICI), aluminized to 20 percent light transmission), and the deposited softenable layers were allowed to dry at about 115° C. for about 2 minutes, resulting in dried softenable layers with thicknesses of about 4 microns. The temperature of the softenable layers was then raised to about 115° C. to lower the viscosity of the exposed surfaces of the softenable layers to about $5\times10^3$ poises in preparation for the deposition of marking material. Thin layers of particulate vitreous selenium were then applied by vacuum deposition in a vacuum chamber maintained at a vacuum of about $4\times10^{-4}$ Torr. The imaging members were then rapidly chilled to room temperature. Reddish monolayers of selenium particles having an average diameter of about 0.3 micron embedded about 0.05 to 0.1 micron below the surfaces of the copolymer layers were formed.

B

Two additional migration imaging members were prepared as described above in Paragraph A. These imaging members were wound onto 1 inch diameter cardboard tube laminating cores. The two rolls of imaging member sheets were mounted on the support brackets in a GBC 5270 laminator, obtained from GBC Canada, Don Mills, Ontario, Canada. The normal operation of this laminator is to have two rolls of laminating material mounted on support brackets. The film is threaded and joined. An item, such as a poster or placemat, for instance, can be placed between the two sheets and run through pinch and drive rollers, resulting in placement of a protective overcoat on both sides of the item. In this instance, the rolls of imaging member were mounted on the support brackets which ordinarily bear the rolls of protective coating material. The imaging members were threaded and joined so that the softenable layer of the first member was in contact with the softenable layer of the second member. Sections of the "sandwich" thus formed were then fed through the laminator at temperatures of 220° F., 250° F., 275° F., and 300° F. After the "sandwich" had passed through the laminator and was cut from the machine, it was left to cool for a few minutes, after which the two layers were carefully peeled apart, resulting in formation of a single migration imaging member having two softenable layers on the aluminized Mylar® substrate.

C

Optical densities of the imaging members formed in Paragraphs A and B above were as follows. All optical density measurements were done using a MacBeth TR927 densitometer. The background values attributable to the substrate were not subtracted from the values shown in the table. The blue setting corresponds to a Wratten No. 47 filter, the blue setting corresponds to a Wratten No. 25 filter, and the ultraviolet setting corresponds to a Wratten No. 18A filter. Ranges of optical density values are provided in instances wherein the optical density varied across the structure.

| Imaging Member | Blue Optical Density | Red Optical Density | Ultraviolet Optical Density |
|---|---|---|---|
| IA | 2.02 | 1.11–1.29 | 3.25 |
| IB at 220° F. | 3.25 | 1.44–1.50 | 4.32 |
| IB at 250° F. | 3.06 | 1.46–1.59 | 4.27 |
| IB at 275° F. | 2.94–2.99 | 1.51 | 4.18–4.23 |
| IB at 300° F. | 2.68–2.55 | 1.50–1.54 | 4.05–3.99 |

For comparison purposes, the optical density of the aluminized polyester substrate was measured at 0.49 (blue), 0.66 (red), and 0.43 (ultraviolet). As the data indicate, the optical density of the unimaged imaging member with a single softenable layer containing a single monolayer of migration marking material was significantly less than the optical densities of the unimaged members having two softenable layers and two monolayers of migration marking material and prepared at various temperatures.

EXAMPLE II

One migration imaging member containing a single softenable layer as prepared in Paragraph A of Example I and four imaging members prepared as described in Paragraph B of Example I (passed through the laminator at 250° F.) were imaged as follows. The surfaces of the members were uniformly negatively charged to surface potentials as indicated in the table below with a corona charging device and were subsequently optically exposed by placing a test pattern mask comprising a silver halide image in contact with the imaging members and exposing the members to blue light of 490 nanometers through the mask for a period of 5 seconds (corresponding to 36.5 ergs per square centimeter). The imaging members were then developed by subjecting them to temperatures as indicated in the table below for about 5 seconds using a small aluminum heating block in contact with the polyester substrates. The temperature of the block was measured using a YSI probe attached to a temperature controller, and the temperatures shown in the table are the values measured by the probe, which would typically be about 5° C. less than the actual surface temperature. The optical densities of the imaging members in the $D_{max}$ and $D_{min}$ areas were as follows. All optical density measurements were done using a MacBeth TR927 densitometer. The background values attributable to the substrate were not subtracted from the values shown in the table. The blue setting corresponds to a Wratten No. 47 filter, the blue setting corresponds to a Wratten No. 25 filter, and the ultraviolet setting corresponds to a Wratten No. 18A filter. Ranges of optical density values are provided in instances wherein the optical density varied across the structure.

| Imaging | Charge | Dev. Temp. | Optical Density (blue) | | | Optical Density (ultraviolet) | | |
|---|---|---|---|---|---|---|---|---|
| Member | (volts) | (°C.) | $D_{max}$ | $D_{min}$ | ΔO.D. | $D_{max}$ | $D_{min}$ | ΔO.D. |
| IA | −388 | 95 | 1.97 | 0.89 | 1.08 | — | — | — |
| IB at 250° F. | −675 | 90 | 3.05–3.11 | 1.24–1.38 | 1.67–1.87 | 5.02 | 3.04 | 1.98 |
| IB at 250° F. | −650 | 92 | 3.09–3.11 | 1.20–1.24 | 1.85–1.91 | 4.99 | 2.89 | 2.10 |
| IB at 250° F. | −647 | 95 | 3.03–3.08 | 1.11–1.13 | 1.90–1.97 | 5.03 | 2.82 | 2.21 |
| IB at 250° F. | −674 | 98 | 3.01–3.06 | 1.13 | 1.88–1.93 | 4.84 | 2.82 | 2.02 |

— indicates not measured

As the data indicate, the blue optical contrast density (ΔO.D.) of the imaged imaging member with a single softenable layer containing a single monolayer of migration marking material was significantly less than the blue optical contrast densities of the imaged members having two softenable layers and two monolayers of migration marking material.

EXAMPLE III

A

Two infrared-sensitive migration imaging members were prepared as follows. A solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto two 3 mil thick polyester substrates (Melinex 442, obtained from Imperial Chemical Industries (ICI), aluminized to 20 percent light transmission), and the deposited softenable layers were allowed to dry at about 115° C. for about 2 minutes, resulting in dried softenable layers with thicknesses of about 2 microns. The temperature of the softenable layers was then raised to about 115° C. to lower the viscosity of the exposed surfaces of the softenable layers to about $5\times10^3$ poises in preparation for the deposition of marking material. Thin layers of particulate vitreous selenium were then applied by vacuum deposition in a vacuum chamber maintained at a vacuum of about $4\times10^{-4}$ Torr. The imaging members were then rapidly chilled to room temperature. Reddish monolayer of selenium particles having an average diameter of about 0.3 micron embedded about 0.05 to 0.1 micron below the surfaces of the copolymer layers were formed.

The migration imaging members thus formed and having a single softenable layer were divided in half and wound onto 1 inch diameter cardboard tube laminating cores. The two rolls of imaging member sheets were mounted on the support brackets in a GBC 5270 laminator which ordinarily bear the rolls of protective coating material. The imaging members were threaded and joined so that the softenable layer of the first member was in contact with the softenable layer of the second member. The "sandwiches" thus formed were then fed through the laminator at a temperature of 250° F. at a rate of 15 feet per minute with the cooling fan in the laminator on. After the "sandwiches" had passed through the laminator and were cut from the machine, they were left to cool for a few minutes, after which the two layers of each "sandwich" were carefully peeled apart, resulting in formation of a single migration imaging member having two softenable layers on the aluminized Mylar® substrate.

The migration imaging members thus formed and having two softenable layers and two monolayers of selenium particles were then treated as follows. A pigment dispersion was prepared by ball milling for 24 hours a mixture comprising 10.6 parts by weight solids in a solvent (wherein the solvent comprised 40 percent by weight 2-propanol and 60 percent by weight deionized water), wherein the solids comprised 20 percent by weight X-metal-free phthalocyanine (prepared as described in U.S. Pat. No. 3,357,989 (Byrne et al.), the disclosure of which is totally incorporated by reference) and 80 percent by weight of a styrene-butyl methacrylate copolymer (ICI Neocryl A622). The resulting dispersion was hand coated onto the top softenable layers of the migration imaging members with a #5 Meyer rod, followed by drying the deposited infrared-sensitive layers at 50° C. for 1 minute by contacting the polyester substrates to an aluminum heating block.

B

Three infrared-sensitive migration imaging members were prepared as described in Paragraph A above except that the substrate, also obtained from ICI, was 4 mils thick and aluminized to 50 percent light transmission.

C

The infrared-sensitive migration imaging members prepared in Paragraphs A and B were imaged as follows. The surfaces of the members were uniformly positively charged to surface potentials as indicated in the table below with a corona charging device and were subsequently exposed by placing a test pattern mask comprising a silver halide image in contact with the imaging members and exposing the members to infrared light of 773 nanometers through the mask for a period of 20 seconds (corresponding to 260 ergs per square centimeter). The exposed members were subsequently uniformly exposed to 490 nanometer light for a period of 10 seconds (corresponding to 53 ergs per square centimeter) and thereafter uniformly negatively recharged to surface potentials as indicated in the table below with a corona charging device. The imaging members were then developed by subjecting them to temperatures as indicated in the table below for periods of time as indicated in the table below using a small aluminum heating block in contact with the polyester substrates. The temperature of the block was measured using a YSI probe attached to a temperature controller, and the temperatures shown in the table are the values measured by the probe, which would typically be about 5° C. less than the actual surface temperature. The optical densities of the imaging members in the $D_{max}$ and $D_{min}$ areas were as follows. All optical density measurements were done using a MacBeth TR927 densitometer. The background values attributable to the substrate were not subtracted from the values shown in the table. The blue setting corresponds to a Wratten No. 47 filter, the blue setting corresponds to a Wratten No. 25 filter, and the ultraviolet setting corresponds to a Wratten No. 18A filter. Ranges of optical density values are provided in instances wherein the optical density varied across the structure.

| Imaging Member | Positive Charge (volts) | Negative Charge (volts) | Development Temperature (°C.) | Development Time (seconds) |
|---|---|---|---|---|
| IIIA(1) | +540 | −475 | 98 | 5 |
| IIIA(2) | +550 | −485 | 98 | 2 |
| IIIB(1) | +300 | −285 | 95 | 5 |
| IIIB(2) | +286 | −232 | 98 | 5 |
| IIIB(3) | +285 | −270 | 98 | 2 |

| Imaging | Optical Density (blue) | | | Optical Density (ultraviolet) | | |
|---|---|---|---|---|---|---|
| Member | $D_{max}$ | $D_{min}$ | ΔO.D. | $D_{max}$ | $D_{min}$ | ΔO.D. |
| IIIA(1) | 2.43 | 1.13 | 1.30 | 4.47–4.96 | 3.12–3.14 | 1.33–1.84 |
| IIIA(2) | 2.81 | 1.36 | 1.45 | 5.00–5.19 | 3.39 | 1.61–1.80 |
| IIIB(1) | 2.97 | 1.33–1.65 | 1.32–1.64 | 4.60–4.80 | 2.60–2.70 | 1.90–2.20 |
| IIIB(2) | 1.85–2.93 | 1.01–2.07 | 0.84–0.86 | 4.65–4.90 | 2.55 | 2.10–2.35 |
| IIIB(3) | 2.75 | 1.05 | 1.70 | — | — | — |

— indicates not measured

The blue optical contrast densities (ΔO.D.) of the imaged imaging members having two softenable layers and two monolayers of migration marking material were, in most instances, higher than the blue optical contrast density of an infrared-sensitive member of similar composition but having only a single softenable layer and a single monolayer of migration marking material, which was 0.90.

EXAMPLE IV

Five infrared-sensitive migration imaging members were prepared as follows. Into 97.5 parts by weight of cyclohexanone (analytical reagent grade, obtained from British Drug House (BDH)) was dissolved 1.75 part by weight of Butvar B-72, a polyvinylbutyral resin (obtained from Monsanto Plastics & Resins Co.). To the solution was added 0.75 part by weight of X-metal free phthalocyanine (prepared as described in U.S. Pat. No. 3,357,989 (Byrne et al.), the disclosure of which is totally incorporated herein by reference) and 100 parts by weight of ⅛ inch diameter stainless steel balls. The dispersion (containing 2.5 percent by weight solids) was ball milled for 24 hours and then hand coated with a #4 wire wound rod onto a 4 mil thick conductive substrate comprising aluminized polyester (Melinex 442, obtained from Imperial Chemical Industries (ICI), aluminized to 20 percent light transmission). After the material was dried on the substrate at about 80° C. for about 20 seconds, the film thickness of the resulting pigment-containing layer was about 0.06 micron.

Thereafter a solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto the infrared-sensitive pigment containing layer of the imaging member, and the deposited softenable layer was allowed to dry at about 115° C. for about 2 minutes, resulting in a dried softenable layer with a thickness of about 8 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the surface of the copolymer layer was formed.

Onto an additional 3 mil thick conductive substrate comprising aluminized polyester (Melinex 442, obtained from Imperial Chemical Industries (ICI), aluminized to 20 percent light transmission) was also coated the solution of the softenable layer composition containing 84 parts by weight of the terpolymer and 16 parts by weight of the charge transport material by the same process, and a thin layer of particulate vitreous selenium was vacuum deposited onto the softenable layer on the 3 mil thick substrate by the same process, resulting in formation of a softenable layer 4 microns thick.

The two imaging members, one having both an infrared-sensitive layer and a softenable layer and one having only a softenable layer, were then wound onto 1 inch diameter cardboard tube laminating cores. The two rolls of imaging member sheets were mounted on the support brackets in a GBC 5270 laminator which ordinarily bear the rolls of protective coating material. The imaging members were threaded and joined so that the softenable layer of the first member was in contact with the softenable layer of the second member. The "sandwich" thus formed was then fed through the laminator at a temperature of 250° F. at a rate of 15 feet per minute with the cooling fan in the laminator on. After the "sandwich" had passed through the laminator and was cut in five pieces from the machine, the pieces were left to cool for a few minutes, after which the two layers of each "sandwich" were carefully peeled apart, resulting in formation of a single migration imaging member having two softenable layers on the infrared-sensitive layer on the aluminized Mylar® substrate.

The infrared-sensitive migration imaging members thus prepared were then imaged as follows. The surfaces of the members were uniformly negatively charged to surface potentials as indicated in the table below with a corona charging device and were subsequently uniformly exposed to 490 nanometer light for the period of time indicated in the table below, followed by imagewise exposure to infrared light by placing a test pattern mask comprising a silver halide image in contact with the imaging members and exposing the members to infrared light of 773 nanometers through the mask for the period of time indicated in the table below. As indicated in the table below, some of the imaging members were subjected to a second negative charging step after the infrared imaging step and some were not. The imaging members were then developed by subjecting them to temperatures as indicated in the table below for 5 seconds using a small aluminum heating block in contact with the polyester substrates. The temperature of the block was measured using a YSI probe attached to a temperature controller, and the temperatures shown in the table are the values measured by the probe, which would typically be about 5° C. less than the actual surface temperature. The optical densities of the imaging members in the $D_{max}$ and $D_{min}$ areas were as follows. All optical density measurements were done using a MacBeth TR927 densitometer. The background values attributable to the substrate were not subtracted from the values shown in the table. The blue setting corresponds to a Wratten No. 47 filter, the blue setting corresponds to a Wratten No. 25 filter, and the ultraviolet setting corresponds to a Wratten No. 18A filter. Ranges of optical density values are provided in instances wherein the optical density varied across the structure.

| Imaging Member | First Negative Charge (volts) | Blue Exposure (seconds) | IR Exposure (seconds) | Seconds Negative Charge (volts) | Development Temperature (°C.) |
|---|---|---|---|---|---|
| IV(1) | −640 | 10 | 20 | — | 115 |
| IV(2) | −650 | 10 | 20 | — | 119 |
| IV(3) | −620 | 10 | 20 | −840 | 119 |
| IV(4) | −650 | 5 | 20 | −840 | 119 |
| IV(5) | −640 | 5 | 10 | −750 | 119 |

— indicates not performed

| Imaging | Optical Density (blue) | | | Optical Density (ultraviolet) | | |
|---|---|---|---|---|---|---|
| Member | $D_{max}$ | $D_{min}$ | ΔO.D. | $D_{max}$ | $D_{min}$ | ΔO.D. |
| IV(1) | 2.85 | 1.12–1.63 | 1.22–1.73 | 4.90–5.15 | 3.15–3.69 | 1.21–2.00 |
| IV(2) | 2.74 | 1.39–1.53 | 1.21–1.35 | 4.92–5.08 | 3.42–3.57 | 1.35–1.66 |
| IV(3) | 2.75 | 1.31–1.40 | 1.35–1.44 | 5.55–5.90 | 3.37–3.44 | 2.11–2.53 |
| IV(4) | 2.74 | 1.24 | 1.50 | 4.60–4.80 | 3.31–3.35 | 1.25–1.49 |
| IV(5) | 2.64–2.75 | 1.31–1.41 | 1.23–1.44 | 4.88–5.00 | 3.28–3.74 | 1.14–1.72 |

The blue optical contrast densities (ΔO.D.) of the imaged imaging members having two softenable layers and two monolayers of migration marking material were significantly higher than the blue optical contrast density of an infrared-sensitive member of similar composition but having only a single softenable layer and a single monolayer of migration marking material, which was 0.90.

Other embodiments and modifications of the present invention may occur to those skilled in the art subsequent to a review of the information presented herein; these embodiments and modifications, as well as equivalents thereof, are also included within the scope of this invention.

What is claimed is:

1. A migration imaging member comprising a substrate, a first softenable layer comprising a first softenable material and a first migration marking material contained at least at or near the surface of the first softenable layer spaced from the substrate, and a second softenable layer comprising a second softenable material and a second migration marking material, wherein the first migration material is the same as the second migration marking material, and wherein the first softenable layer is situated between the second softenable layer and the substrate.

2. A migration imaging member according to claim 1 wherein the first softenable material is the same as the second softenable material.

3. A migration imaging member according to claim 1 wherein the first and second migration marking materials are both selenium.

4. A migration imaging member according to claim 1 wherein at least one of the first and second softenable layers contains a charge transport material selected from the group consisting of diamine hole transport materials, pyrazoline hole transport materials, hydrazone hole transport materials, triarylamines, substituted diarylmethane compounds, substituted triaryl methane compounds, and mixtures thereof.

5. A migration imaging member according to claim 1 wherein at least one of the first and second softenable layers contains a charge transport material selected from the group consisting of tritolyl amine, bis-(4-diethylamino2-methylphenyl)-phenylmethane, and mixtures thereof.

6. A migration imaging member according to claim 1 wherein the first migration marking material is present in the first softenable layer as a monolayer of particles situated at or near the surface of the first softenable layer spaced from the substrate.

7. A migration imaging member according to claim 6 wherein the second migration marking material is present in the second softenable layer as a monolayer of particles.

8. A migration imaging member according to claim 7 wherein the monolayer of second migration marking material in the second softenable layer is situated at or near the surface of the second softenable layer in contact with the first softenable layer.

9. A migration imaging member according to claim 7 wherein the monolayer of second migration marking material in the second softenable layer is situated at or near the surface of the second softenable layer most distant from the substrate.

10. A migration imaging member according to claim 1 wherein the imaging member comprises at least three softenable layers, wherein each softenable layer comprises a softenable material and a migration marking material.

11. A migration imaging member according to claim 1 also comprising an infrared or red light radiation sensitive layer which comprises a pigment predominantly sensitive to infrared or red light radiation, wherein the first and second migration marking materials are predominantly sensitive to radiation at a wavelength other than that to which the infrared or red light sensitive pigment is sensitive, and wherein at least one of the first and second softenable layers contain a charge transport material.

12. A migration imaging member according to claim 11 wherein the infrared or red light radiation sensitive layer is situated between the substrate and the softenable layers.

13. A migration imaging member according to claim 11 wherein the softenable layers are situated between the substrate and the infrared or red light radiation sensitive layer.

14. A migration imaging member according to claim 11 wherein the pigment sensitive to infrared or red light radiation is selected from the group consisting of benzimidazole perylene, dibromoanthranthrone, trigonal selenium, beta-metal free phthalocyanine, X-metal free phthalocyanine, vanadyl phthalocyanine, chloroindium phthalocyanine, titanyl phthalocyanine, chloroaluminum phthalocyanine, copper phthalocyanine, magnesium phthalocyanine, and mixtures thereof.

15. A migration imaging process which comprises (1) providing a migration imaging member comprising a substrate, a first softenable layer comprising a first softenable material and a first migration marking material contained at least at or near the surface of the first softenable layer spaced from the substrate, and a second softenable layer comprising a second softenable material and a second migration marking material, wherein the first migration material is the same as the second migration marking material, and wherein the first softenable layer is situated between the second softenable layer and the substrate; (2) uniformly charging the imaging member; (3) subsequent to step (2), exposing the charged imaging member to activating radiation at a wavelength to which the migration marking materials are sensitive in an imagewise pattern, thereby forming an electrostatic latent image on the imaging member; and (4) subsequent to step (3), causing the softenable materials to soften, thereby enabling the migration marking materials to migrate through the softenable materials toward the substrate in an imagewise pattern.

16. A migration imaging process according to claim 15 wherein the first softenable material is the same as the second softenable material.

17. A migration imaging process according to claim 15 wherein the first and second migration marking materials are both selenium.

18. A migration imaging process according to claim 15 wherein at least one of the first and second softenable layers contains a charge transport material selected from the group consisting of diamine hole transport materials, pyrazoline hole transport materials, hydrazone hole transport materials, triarylamines, substituted diarylmethane compounds, substituted triarylmethane compounds, and mixtures thereof.

19. A migration imaging process according to claim 15 wherein at least one of the first and second softenable layers contains a charge transport material selected from the group consisting of tritolyl amine, bis-(4-diethylamino2-methylphenyl)-phenylmethane, and mixtures thereof.

20. A migration imaging process according to claim 15 wherein the softenable materials are caused to soften by the application of heat.

21. A migration imaging process according to claim 15 wherein the first migration marking material is present in the first softenable layer as a monolayer of particles situated at or near the surface of the first softenable layer spaced from the substrate.

22. A migration imaging process according to claim 15 wherein the second migration marking material is present in the second softenable layer as a monolayer of particles.

23. A migration imaging process according to claim 22 wherein the monolayer of second migration marking material in the second softenable layer is situated at or near the surface of the second softenable layer in contact with the first softenable layer.

24. A migration imaging process according to claim 22 wherein the monolayer of second migration marking material in the second softenable layer is situated at or near the surface of the second softenable layer most distant from the substrate.

25. A migration imaging process according to claim 15 wherein the imaging member comprises at least three softenable layers, wherein each softenable layer comprises a softenable material and a migration marking material.

26. A migration imaging process according to claim 15 wherein the migration imaging member also comprising an infrared or red light radiation sensitive layer which comprises a pigment predominantly sensitive to infrared or red light radiation, wherein the first and second migration marking materials are predominantly sensitive to radiation at a wavelength other than that to which the infrared or red light sensitive pigment is sensitive, wherein at least one of the first and second softenable layers contain a charge transport material, and wherein the process comprises the steps of (A) uniformly charging the imaging member; (B) subsequent to step A, exposing the charged imaging member to infrared or red light radiation at a wavelength to which the infrared or red light radiation sensitive pigment is sensitive in an imagewise pattern, thereby forming an electrostatic latent image on the imaging member; (C) subsequent to step A, uniformly exposing the imaging member to activating radiation at a wavelength to which the migration marking materials are sensitive; and (D) subsequent to steps B and C, causing the softenable materials to soften, thereby enabling the migration marking materials to migrate through the softenable materials toward the substrate in an imagewise pattern.

27. A migration imaging process according to claim 26 wherein the infrared or red light radiation sensitive layer is situated between the substrate and the softenable layers.

28. A migration imaging process according to claim 26 wherein the softenable layers are situated between the substrate and the infrared or red light radiation sensitive layer.

29. A migration imaging process according to claim 26 wherein the pigment sensitive to infrared or red light radiation is selected from the group consisting of benzimidazole perylene, dibromoanthranthrone, trigonal selenium, beta-metal free phthalocyanine, X-metal free phthalocyanine, vanadyl phthalocyanine, chloroindium phthalocyanine, titanyl phthalocyanine, chloroaluminum phthalocyanine, copper phthalocyanine, magnesium phthalocyanine, and mixtures thereof.

30. A migration imaging process according to claim 26 wherein subsequent to steps (B) and (C) and before step (D) the imaging member is uniformly recharged.

31. A migration imaging process according to claim 30 wherein the recharging is to a polarity opposite to that to which the imaging member was charged in step (A).

32. A migration imaging process according to claim 30 wherein the recharging is to a polarity the same as that to which the imaging member was charged in step (A).

33. A migration imaging process according to claim 26 wherein step (B) takes place before step (C).

34. A migration imaging process according to claim 26 wherein step (C) takes place before step (B).

35. A process for preparing a migration imaging member which comprises (1) applying to an imaging member substrate a first softenable layer comprising a first softenable material and a first migration marking material contained at least at or near the surface of the first softenable layer spaced from the substrate, wherein additional layers are optionally situated between the substrate and the first softenable layer; (2) applying to a support a second softenable layer comprising a second softenable material and a second migration marking material, wherein additional layers are optionally situated between the support and the second softenable layer; (3) subsequent to steps (1) and (2), placing the first softenable layer in contact with the second softenable layer and causing the first softenable layer to adhere to the second softenable layer; and (4) subsequent to step (3), removing the support from the second softenable layer.

36. A process for preparing a migration imaging member which comprises (1) applying to a first support a first softenable layer comprising a first softenable material and a first migration marking material contained at least at or near the surface of the first softenable layer spaced from the first support, wherein additional layers are optionally situated between the first support and the first softenable layer; (2) applying to a second support a second softenable layer comprising a second softenable material and a second migration marking material, wherein additional layers are optionally situated between the second support and the second softenable layer; (3) subsequent to steps (1) and (2), placing the first softenable layer in contact with the second softenable layer and causing the first softenable layer to adhere to the second softenable layer; (4) subsequent to step (3), removing the first support from the first softenable layer; (5) subsequent to step (4), placing the first softenable layer in contact with a substrate and causing the first softenable layer to adhere to the substrate, wherein additional layers are optionally situated between the substrate and the first softenable layer; and (6) subsequent to step (5), removing the second support from the second softenable layer.

37. A migration imaging member consisting essentially of, in the order stated: (a) a conductive substrate layer; (b) an optional adhesive layer situated on the substrate; (c) an optional charge blocking layer situated either on the conductive substrate layer or on the optional adhesive layer; (d) an optional charge transport layer situated either on the conductive substrate layer, on the optional adhesive layer, or on the optional charge blocking layer; (e) a first softenable layer situated either on the conductive substrate layer, on the optional adhesive layer, on the optional charge blocking layer, or on the optional charge transport layer, said first softenable layer comprising a first softenable material and a first migration marking material contained at least at or near the surface of the first softenable layer spaced from the substrate; (f) a second softenable layer situated on the first softenable layer, said second softenable layer comprising a second softenable material and a second migration marking material; and (g) an optional overcoating layer situated on the second softenable layer.

38. A migration imaging member consisting essentially of, in the order stated: (a) a conductive substrate layer; (b) an optional adhesive layer situated on the substrate; (c) an optional charge blocking layer situated either on the conductive substrate layer or on the optional adhesive layer; (d) an optional charge transport layer situated either on the conductive substrate layer, on the optional adhesive layer, or on the optional charge blocking layer; (e) a first softenable layer situated either on the conductive substrate layer, on the optional adhesive layer, on the optional charge blocking layer, or on the optional charge transport layer, said first softenable layer comprising a first softenable material and a first migration marking material contained at least at or near the surface of the first softenable layer spaced from the substrate; (f) a second softenable layer situated on the first softenable layer, said second softenable layer comprising a second softenable material and a second migration marking material, wherein at least one of the first and second softenable layers contain a charge transport material; (g) an infrared or red-light radiation sensitive layer situated on the second softenable layer, said infrared or red light radiation sensitive layer comprising a pigment predominantly sensitive to infrared or red light radiation, wherein the first and second migration marking materials are predominantly sensitive to radiation at a wavelength other than that to which the infrared or red light sensitive pigment is sensitive; and (h) an optional overcoating layer situated on the infrared or red light radiation sensitive layer.

39. A migration imaging member consisting essentially of, in the order stated: (a) a conductive substrate layer; (b) an optional adhesive layer situated on the substrate; (c) an optional charge blocking layer situated either on the conductive substrate layer or on the optional adhesive layer; (d) an infrared or red-light radiation sensitive layer situated either on the conductive substrate layer, on the optional adhesive layer, or on the optional charge blocking layer, said infrared or red light radiation sensitive layer comprising a pigment predominantly sensitive to infrared or red light radiation; (e) an optional charge transport layer situated on the infrared or red light radiation sensitive layer; (f) a first softenable layer situated either on the infrared or red light sensitive layer or on the optional charge transport layer, said first softenable layer comprising a first softenable material and a first migration marking material contained at least at or near the surface of the first softenable layer spaced from the substrate; (g) a second softenable layer situated on the first softenable layer, said second softenable layer comprising a second softenable material and a second migration marking material, wherein at least one of the first and second softenable layers contain a charge transport material, and wherein the first and second migration marking materials are predominantly sensitive to radiation at a wavelength other than that to which the infrared or red light sensitive pigment is sensitive; and (h) an optional overcoating layer situated on the second softenable layer.

40. A migration imaging process which comprises (1) providing a migration imaging member consisting essentially of, in the order stated: (a) a conductive substrate layer; (b) an optional adhesive layer situated on the substrate; (c) an optional charge blocking layer situated either on the conductive substrate layer or on the optional adhesive layer; (d) an optional charge transport layer situated either on the conductive substrate layer, on the optional adhesive layer, or on the optional charge blocking layer; (e) a first softenable layer situated either on the conductive substrate layer, on the optional adhesive layer, on the optional charge blocking layer, or on the optional charge transport layer, said first softenable layer comprising a first softenable material and a first migration marking material contained at least at or near the surface of the first softenable layer spaced from the substrate; (f) a second softenable layer situated on the first softenable layer, said second softenable layer comprising a second softenable material and a second migration marking material; and (g) an optional overcoating layer situated on the second softenable layer; (2) uniformly charging the imaging member; (3) subsequent to step (2), exposing the charged imaging member to activating radiation at a wavelength to which the migration marking materials are sensitive in an imagewise pattern, thereby forming an electrostatic latent image on the imaging member; and (4) subsequent to step (3), causing the softenable materials to soften, thereby enabling the migration marking materials to migrate through the softenable materials toward the substrate in an imagewise pattern.

41. A migration imaging process according to claim 40 wherein the migration imaging member also contains an infrared or red light radiation sensitive layer which comprises a pigment predominantly sensitive to infrared or red light radiation, wherein the first and second migration marking materials are predominantly sensitive to radiation at a wavelength other than that to which the infrared or red light sensitive pigment is sensitive, wherein at least one of the first and second softenable layers contain a charge transport material, and wherein the process comprises the steps of (A) uniformly charging the imaging member; (B) subsequent to step A, exposing the charged imaging member to infrared or red light radiation at a wavelength to which the infrared or red light radiation sensitive pigment is sensitive in an imagewise pattern, thereby forming an electrostatic latent image on the imaging member; (C) subsequent to step A, uniformly exposing the imaging member to activating radiation at a wavelength to which the migration marking materials are sensitive; and (D) subsequent to steps B and C, causing the softenable materials to soften, thereby enabling the migration marking materials to migrate through the softenable materials toward the substrate in an imagewise pattern.

* * * * *